US006892035B2

(12) United States Patent
Matsumoto et al.

(10) Patent No.: US 6,892,035 B2
(45) Date of Patent: May 10, 2005

(54) DEVELOPING DEVICE, A PROCESS CARTRIDGE, AND AN ELECTROPHOTOGRAPHIC IMAGE FORMING APPARATUS FOR DETECTING AN AMOUNT OF DEVELOPER

(75) Inventors: Hideki Matsumoto, Mishima (JP); Kazushige Sakurai, Mishima (JP); Takeo Shoji, Shizuoka-ken (JP); Toshiyuki Karakama, Shizuoka-ken (JP); Toru Oguma, Mishima (JP); Katsuhiro Kojima, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/826,171

(22) Filed: Apr. 5, 2001

(65) Prior Publication Data

US 2002/0021908 A1 Feb. 21, 2002

(30) Foreign Application Priority Data

Apr. 6, 2000 (JP) ..... 2000/105505

(51) Int. Cl.[7] ..... G03G 15/08
(52) U.S. Cl. ..... 399/27
(58) Field of Search ..... 399/61, 62, 30, 399/27

(56) References Cited

U.S. PATENT DOCUMENTS 5,465,619 A 11/1995 Sotack et al. ..... 73/304
5,923,918 A * 7/1999 Nakagawa et al. ..... 399/27
6,016,413 A * 1/2000 Yokoyama et al.
6,226,464 B1 * 5/2001 Suwa et al. ..... 399/27
6,343,193 B1 * 1/2002 Matsumoto et al. ..... 399/27
6,397,018 B1 * 5/2002 Matsumoto et al. ..... 399/27
6,415,112 B1 7/2002 Kimizuka et al. ..... 399/27

FOREIGN PATENT DOCUMENTS

| | | | |
|---|---|---|---|
| EP | 0 784 250 A2 | | 7/1997 |
| EP | 1 016 939 A2 | * | 7/2000 |
| JP | 2-51180 | * | 2/1990 |
| JP | 3-225382 | * | 10/1991 |
| JP | 4-355477 | * | 12/1992 |
| JP | 8-339188 | * | 12/1996 |
| JP | 10-319821 | * | 12/1998 |
| JP | 11-338241 | * | 12/1999 |
| JP | 2000-206774 | | 7/2000 |
| JP | 2001-51490 | * | 2/2001 |

* cited by examiner

*Primary Examiner*—Susan Lee
(74) *Attorney, Agent, or Firm*—Fitzpatrick, Cella, Harper & Scinto

(57) ABSTRACT

A developing device usable with a main assembly of an electrophotographic image forming apparatus includes a developing member for supplying a developer to an electrophotographic photosensitive member for developing an electrostatic latent image formed on the electrophotographic photosensitive member, a first electrode, and a second electrode. An electrical signal is generated in accordance with an electrostatic capacity between the first electrode and second electrode when the first electrode or the second electrode is supplied with a voltage from the main assembly of the electrophotographic image forming apparatus, and is measured by the main assembly of the electrophotographic image forming apparatus to detect a remaining amount of the developer.

53 Claims, 27 Drawing Sheets

DEVELOPING DEVICE, A PROCESS CARTRIDGE, AND AN ELECTROPHOTOGRAPHIC IMAGE FORMING APPARATUS FOR DETECTING AN AMOUNT OF DEVELOPER

FIELD OF THE INVENTION AND RELATED ART

The present invention relates to a developing device, a process cartridge and an image forming apparatus, wherein an electrostatic latent image is formed through an electrophotographic process, and then is developed into a visual image with a developer contained in a developing device.

Here, the electrophotographic image forming apparatus is an apparatus which forms an image on a recording material through an electrophotographic process. The electrophotographic image forming apparatus may be an electrophotographic copying machine, an electrophotographic printer (a LED printer, a laser beam printer or the like), an electrophotographic printer type facsimile machine, an electrophotographic printer type word processor or the like.

The process cartridge is a cartridge containing as a unit an electrophotographic photosensitive drum and a charge member, a developing member or a cleaning member, the unit being detachably mountable to the main assembly of the image forming apparatus. The process cartridge is a cartridge containing as a unit an electrophotographic photosensitive drum and at least one of a charge member, a developing member and a cleaning member, the unit being detachably mountable to the main assembly of the image forming apparatus. The process cartridge may contain as a unit an electrophotographic photosensitive drum and at least a developing member, the unit being detachably mountable to a main assembly of the electrophotographic image forming apparatus.

In an electrophotographic image forming apparatus using the electrophotographic image forming process, use has been made of the process cartridge type in which the process cartridge comprises as a unit the electrophotographic photosensitive member and process means actable on the electrophotographic photosensitive member, the unit being detachably mountable to the main assembly of the electrophotographic image forming apparatus. With the use of the process cartridge type apparatus, the maintenance operation can be carried out in effect by the users without the necessity of relying on serviceman, and therefore, the operability is improved. Therefore, the process cartridge type apparatus is widely used in the field of electrophotographic image forming apparatus.

With the electrophotographic image forming apparatus of such a process cartridge type, the user exchanges the cartridge by himself or herself. Therefore, there is provided a developer amount detecting means by which the user is notified of the shortage of the developer in the process cartridge.

As a conventional example of the developer amount detecting means, there is a type in which two electrode rods are provided in the developer container of the developing means, and a change in the part between the two electrode rods to detect the presence or absence of the developer is detected. This is called a "yes-or- no type" device. Various systems of this type have been put into practice.

Recently, it is desired that the remaining amount of the developer is detected continuously or substantially in real-time (real-time or continuous type) and such detection has been provided. With this type of apparatus, the user can be notified of the remaining amount of the developer substantially in real-time to facilitate exchanging of the process cartridge.

SUMMARY OF THE INVENTION

Accordingly, it is a principal object of the present invention to provide a developing device, a process cartridge and an electrophotographic image forming apparatus wherein the remaining amount of the developer can be detected in substantially real-time.

It is another object of the present invention to provide a developing device, a process cartridge and an electrophotographic image forming apparatus wherein the remaining amount of the developer can be detected with precision.

According to an aspect of the present invention, there is provided an electrophotographic image forming apparatus, a process cartridge and a developing device for developing an electrostatic latent image formed on an electrophotographic photosensitive member, the developing device being usable with a main assembly of an electrophotographic image forming apparatus, the developing device comprising: a developing member for supplying a developer to the electrophotographic photosensitive member for developing the electrostatic latent image formed on the electrophotographic photosensitive member, a first electrode provided opposed to the developing member; and a second electrode disposed such that at least a lower end thereof takes a position lower than the first electrode when the developing device is mounted to the main assembly of the electrophotographic image forming apparatus. An electrical signal is generated in accordance with an electrostatic capacity between the first electrode and second electrode when the first electrode or second electrode is supplied with a voltage from the main assembly of the electrophotographic image forming apparatus, and is measured by the main assembly of the electrophotographic image forming apparatus to detect a remaining amount of the developer.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, a developing apparatus, a process cartridge, and an electrophotographic image forming apparatus, which are in accordance with the present invention, will be described with reference to the appended drawings.

Embodiment 1

Figure 1:
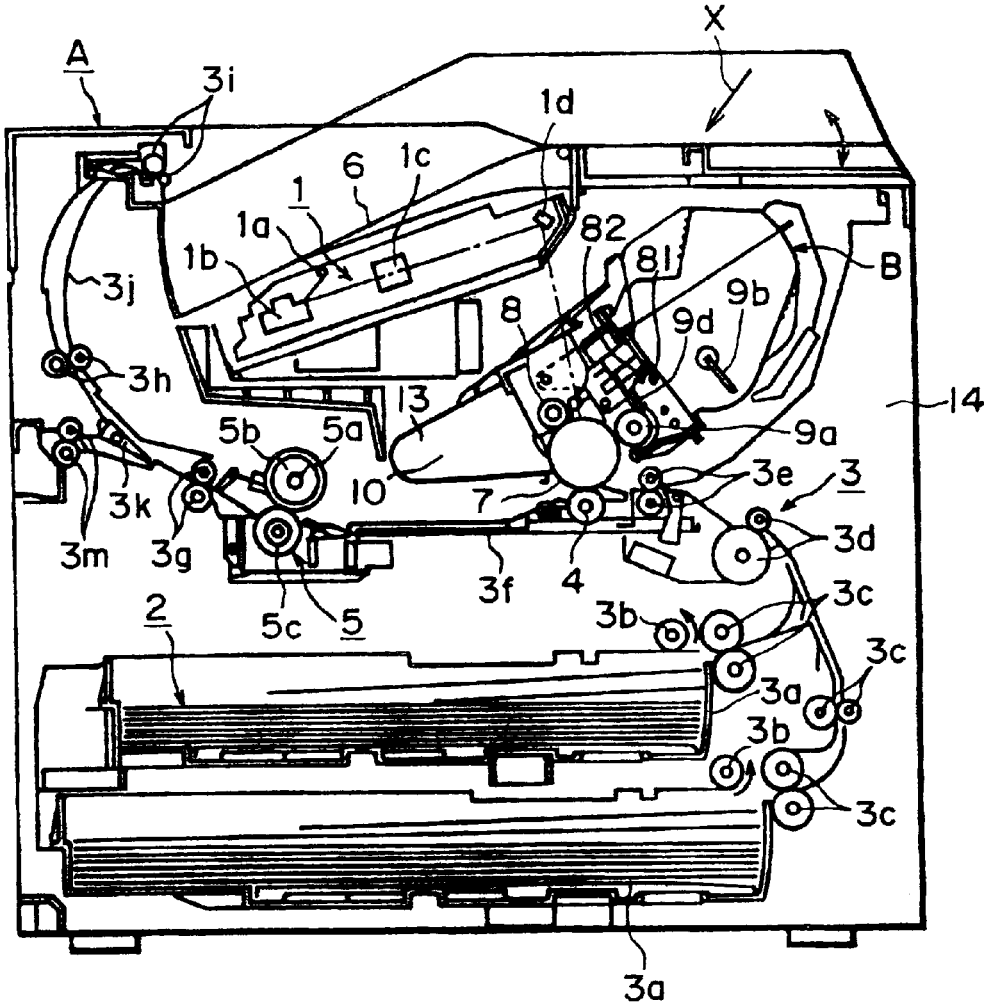
FIG. 1 is a schematic illustration of an electrophotographic image forming apparatus according to an embodiment of the present invention.
Figure 2:
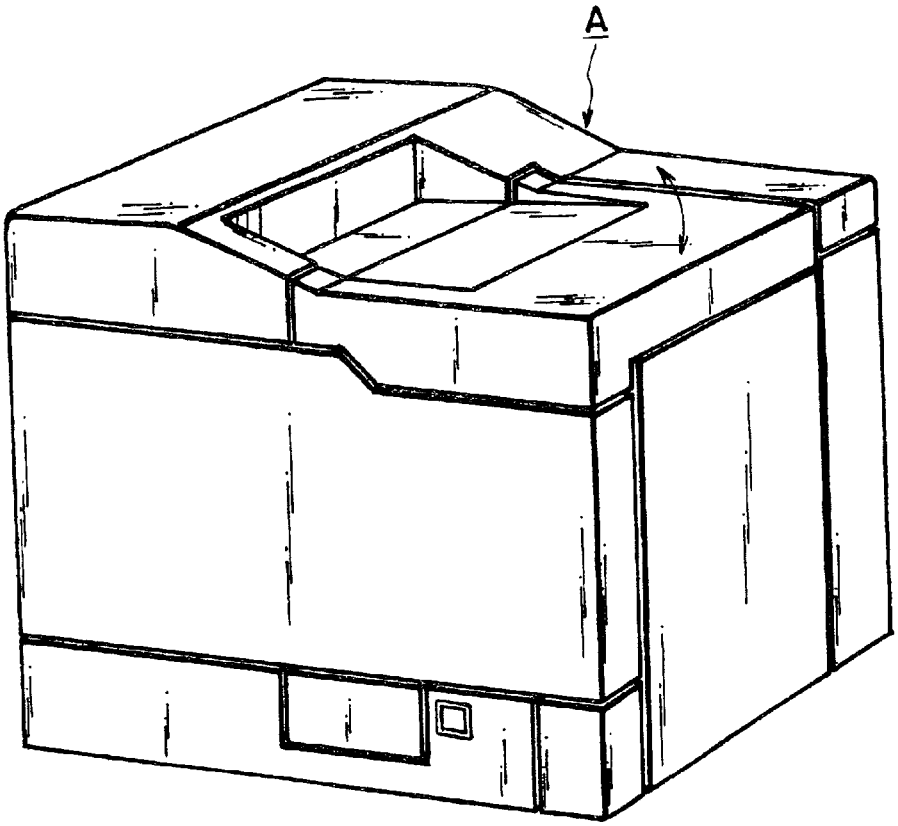
FIG. 2 is an outer perspective view of an electrophotographic image forming apparatus according to an embodiment of the present invention.

First, referring to FIGS. 1–3, an example of an electrophotographic image forming apparatus in which a process cartridge structured in accordance with the present invention is removably mountable will be described. In this embodiment, the electrophotographic image forming apparatus is an electrophotographic laser beam printer A, and forms an image on a recording medium, for example, a recording paper, an OHP sheet, a fabric, and the like, with the use of an electrophotographic image formation process.

The laser beam printer A has an electrophotographic photosensitive member in the form of a drum, that is, a photosensitive drum 7. The photosensitive drum 7 is charged by a charge roller 8 as a charging means, and the charged photosensitive drum 7 is exposed to the laser beam projected in accordance with image formation data, from an optical means 1, as an electrostatic latent image forming means, which has a semiconductor laser 1*a* as a light source, a rotational polygonal mirror 1*c* rotated by a scanner motor 1*b*, and a reflection mirror 1*d*. As a result, a latent image in accordance with the image formation data is formed on the photosensitive drum 7. This latent image is developed into a visible image, or a toner image, by a developing means 9.

More specifically, the developing means 9 has a development chamber 9A equipped with a development roller 9*a* as a developing member, and a developer container 11, as a developer holding portion. The developer container 11 is located next to the development chamber 9A, and contains a developer stirring-conveying member 9*b* (developer stirring means). As the developer stirring member 9*b* is rotated, developer T is sent to the developer roller 9*a* in the development chamber 9A. In the development chamber 9, a developer stirring member 9*e* is positioned adjacent to the development roller 9*a*, and circulates the developer through the development chamber 9A. The developer T used in this embodiment is magnetic developer.

The development roller 9*a* contains a stationary magnet 9*c*. As the development roller 9*a* is rotated, the developer is borne on the development roller 9*a* and is carried in the rotational direction of the development roller 9*a*. As the development roller 9*a* is further rotated, the developer on the development roller 9*a* is given triboelectrical charge by the development blade 9*d* while being formed into a developer layer with a predetermined thickness, and then is supplied to the development region of the photosensitive drum 7. As the developer is supplied to the development region, it is transferred onto the latent image on the photosensitive drum 7, forming a toner image. The development roller 9*a* is electrically connected to a development bias circuit, which applies development bias voltage to the development roller 9*a*. Normally, the development bias voltage is compound voltage, composed of AC voltage and DC voltage, applied to the development roller 9*a*.

Meanwhile, a recording medium 2, for example, a piece of ordinary paper, having been placed in a sheet feeder cassette 3*a*, is conveyed to a transfer station by a pickup roller 3*b*, conveyer roller pairs 3*c* and 3*d*, and a registration roller pair 3*e*, in synchronism with the formation of the toner image. In the transfer station, a transfer roller 4 as a transferring means is positioned. As voltage is applied to the transfer roller 4, the toner image on the photosensitive drum 7 is transferred onto the recording medium 2.

After the transfer of the toner image onto the recording medium 2, the recording medium 2 is conveyed to a fixing means 5 by a conveyance guide 3*f*. The fixing means 5 has a driver roller 5*c* and a fixing roller 5*b*. The fixing roller 5*b* contains a heater 5*a*. As the recording medium 2 is passed through the fixing means 5, the fixing means 5 fixes the unfixed toner image on the recording medium 2 to the recording medium 2 by the application of heat and pressure.

Thereafter, the recording medium is conveyed further, and is discharged into a delivery tray 6, through a reversing path 3*j*, by discharge roller pairs 3*g*, 3*y*, and 3*i*. The delivery tray 6 is located on top the main assembly 14 of the laser beam printer A, that is, an electrophotographic image forming apparatus. The pointing direction of a pivotal flapper 3*k* may be switched to discharge the recording medium 2 by a discharge roller pair 8*m* without passing the recording medium 2 through the reversing path 3*j*. In this embodiment, the aforementioned pickup roller 3*b*, the conveyer roller pairs 3*c* and 3*d*, the registration roller pair 3*c*, the conveyance guide 3*f*, the discharger roller pairs 3*g*, 3*h*, and 3*i*, and the discharge roller pair 3*m*, constitute a conveying means.

Figure 3:
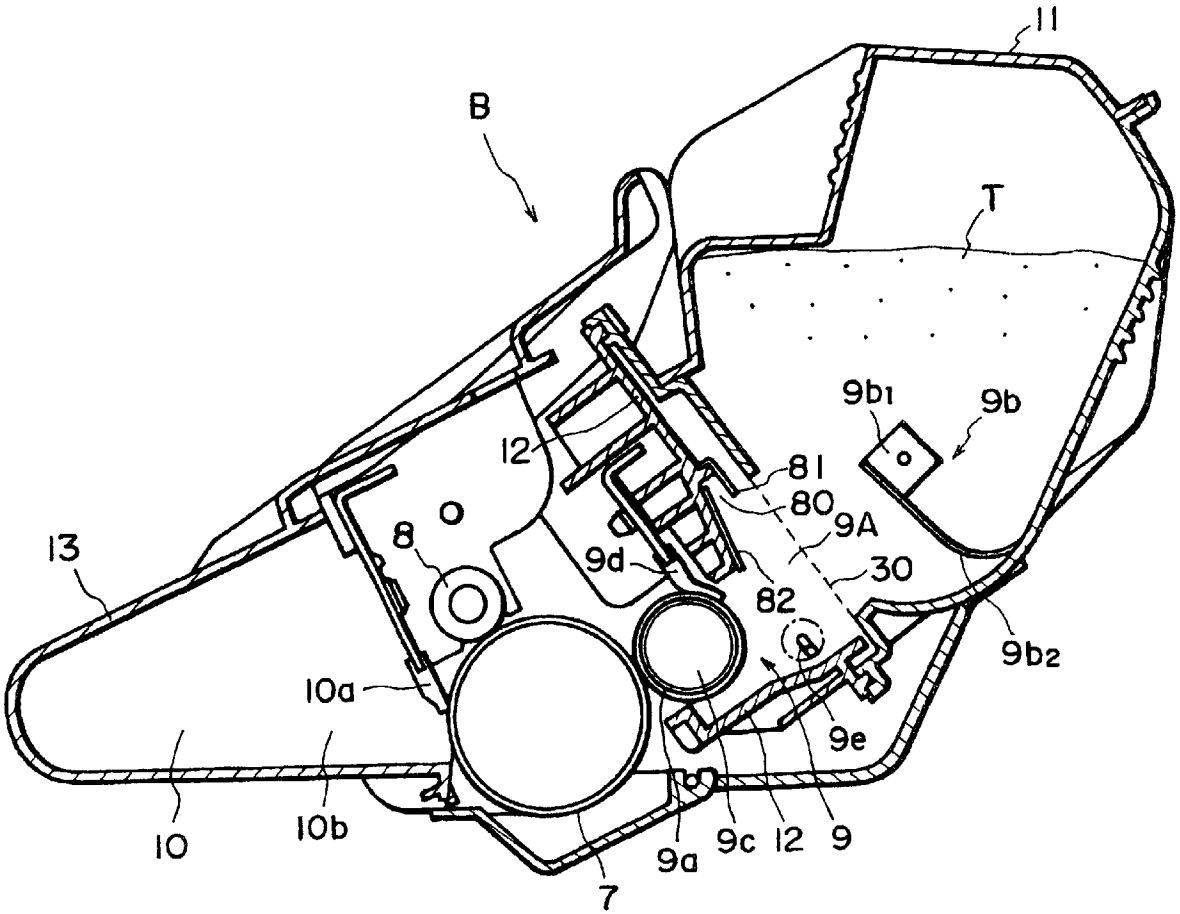
FIG. 3 is a longitudinal sectional view of a process cartridge according to an embodiment of the present invention.

Referring to FIG. 3, in this embodiment, a process cartridge B is assembled in the following manner. First, the developer container 11 (developer holding portion) which has the developer stirring-convening member 9*b* and holds developer, and the development chamber 9A which holds the developing means 9, are welded together to form a development unit, and then, the thus formed development unit is joined with a cleaning means container 13 in which the photosensitive drum 7, a cleaning means 10 comprising cleaning blade 10*a* and the like, and the charge roller 8, are attached. Incidentally, the developing means 9 comprises the development roller 9*a*, the development blade 9*d*, and the like.

Figure 4:
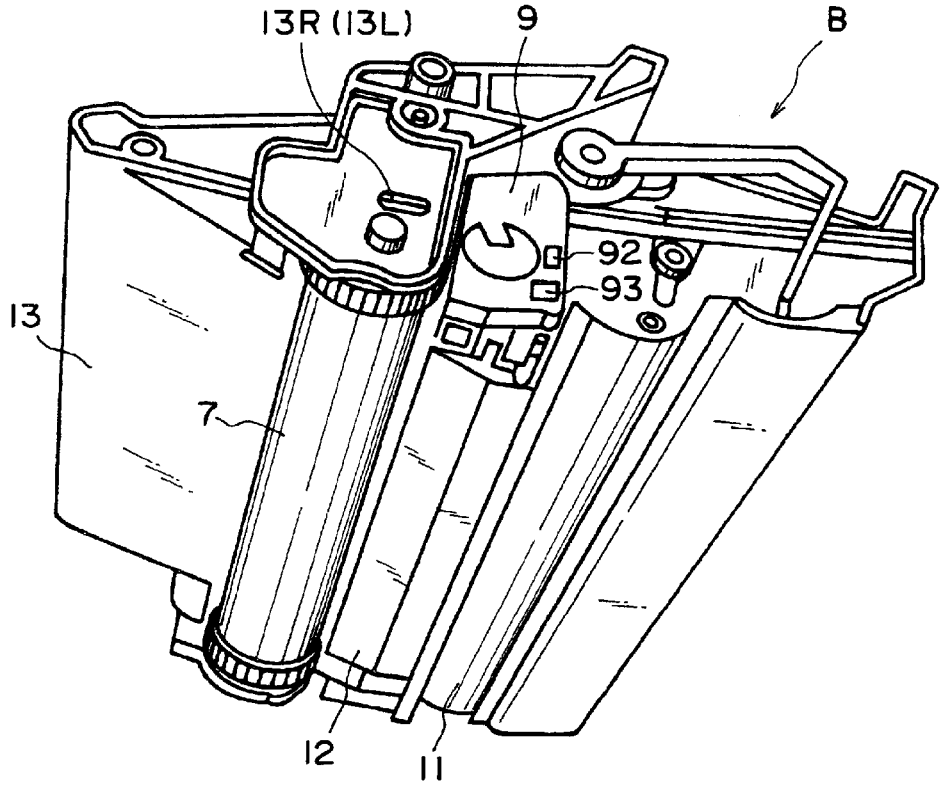
FIG. 4 is an outer perspective view of a process cartridge according to an embodiment of the present invention, as seen from bottom.
Figure 5:
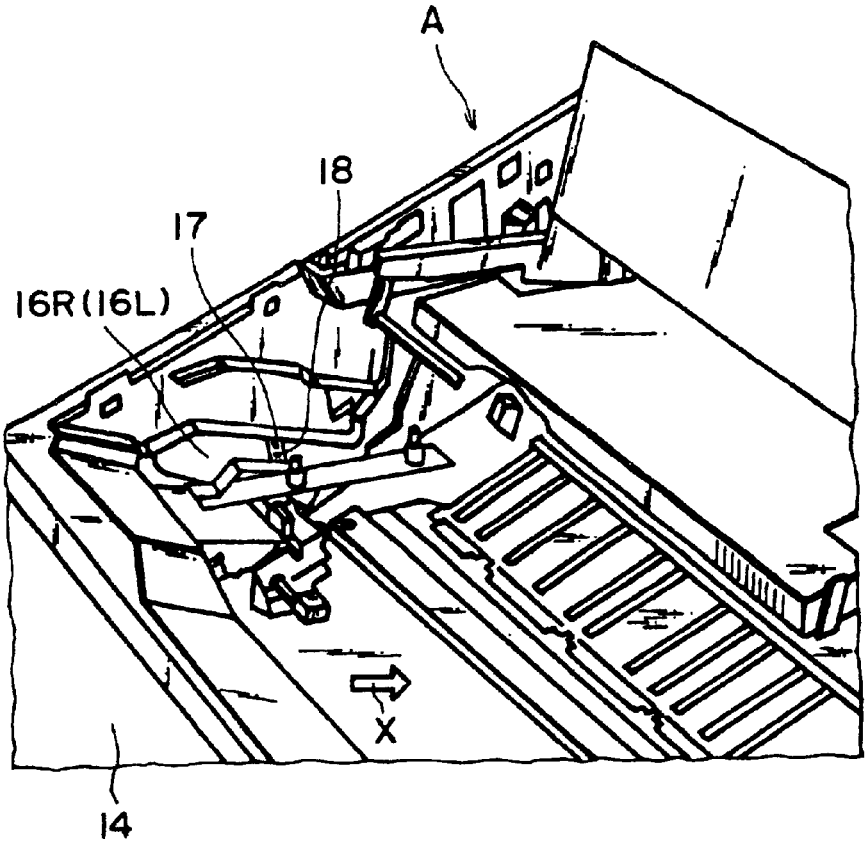
FIG. 5 is an outer perspective view of a mounting portion of a main assembly of the apparatus for mounting the process cartridge.

The process cartridge B is removably mounted by a user into a cartridge mounting means provided in the main assembly 14 of the electrophotographic image forming apparatus, in the direction indicated by an arrow mark X. In this embodiment, the cartridge mounting means comprises a pair of guiding means 13R and 13L (unillustrated), and a pair of guiding portions 16R and 16L (unillustrated). The guiding means 13R are located, one for one, on the external surfaces of the end walls located at the longitudinal ends of the process cartridge B, as shown in FIG. 4, and the guiding portions 16R and 16L, into which the guiding means 13R and 13L are insertable, one for one, are provided on the apparatus main assembly side, as shown in FIG. 5.

According to the present invention, the process cartridge B is provided with a developer amount detecting apparatus capable of continuously (substantially in real-time) detecting the amount of the developer remaining in the developer container 11, as the developer is consumed.

Figure 6:
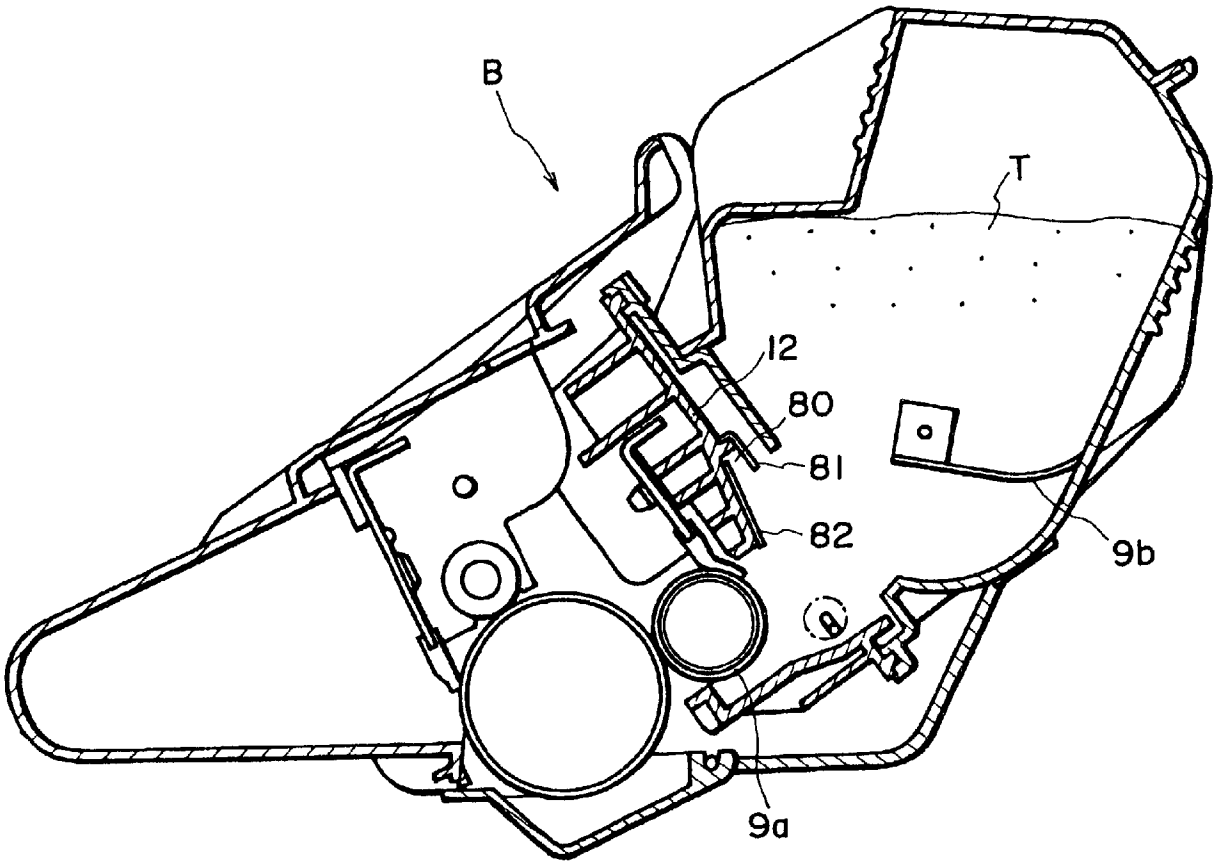
FIG. 6 shows an arrangement of first and second electrodes and a recess in a developer amount detecting means according to an embodiment of the present invention.

Referring to FIG. 6, according this embodiment, the developer amount detecting apparatus is provided with first and second electrodes 81 and 82, between which a recess 80 is present. The recess 80 opens downward in a manner to allow developer to enter the recess 80 after developer is sent thereto by the developer stirring-conveying member 9*b*. Further, the electrodes 81 and 82 are placed approximately in parallel to the development roller 9*a* and also approximately in a manner to oppose each other. In other words, in terms of the direction perpendicular to the direction in which the developer T is moved by the developer stirring-conveying member 9*b* (stirring member), the first electrode 81 is located at a position different from the position where the second electrode 82 is located. The first and second electrodes 81 and 82 are attached to a portion 12 of the process cartridge frame (hereinafter, "frame portion 12"), which constitutes the wall of the development chamber 9A. More specific structural arrangements of the electrodes 81 and 82 will be described later in detail.

The developer amount is detected by applying AC voltage to either the first or second electrodes 81 and 82 and measuring the electrical signals generated in accordance with the electrostatic capacity between the electrodes 81 and 82.

Next, the movement of the developer, and the manner in which the amount of the developer decreases, will be described, starting from a point in time prior to the shipment of the process cartridge, through the period in which the developer in a process cartridge is consumed after the mounting of the process cartridge into the main assembly 14 of the electrophotographic image forming apparatus.

Referring to FIG. 3, prior to the shipment of a process cartridge, a seal 30 for sealing the developer container 11 is pasted between the development chamber 9A and the developer container 11, as indicated by the dotted line in FIG. 3, so that the developer is prevented from leaking outward due to the vibrations or the like which occur as the process cartridge is transported.

When a user uses a brand-new process cartridge, the user is to mount the process cartridge into the electrophotographic image forming apparatus main assembly 14 after removing the seal 30. Some of the recent electrophotographic image forming apparatuses, however, are structured so that the seal 30 is automatically removed after the mounting of a process cartridge into the electrophotographic image forming apparatus main assembly 14.

As described previously, the developer stirring-conveying member 9*b* is provided in the developer container 11. The developer stirring-conveying member 9*b* comprises a stirring shaft 9*b*1, and an elastic sheet 9*bs* (Mylar) attached to the stirring shaft 9*b*1. The developer within the developer container 11 is conveyed into the development chamber 9A by the rotation of the developer stirring-conveying member 9*b*. In this embodiment, the developer stirring-conveying member 9*b* rotates once in every four seconds.

Due to the function of the developer stirring-conveying member 9*b*, the developer is instantly sent into the development chamber 9A, smoothly readying the image forming apparatus for an image forming operation, even when the process cartridge B is used for the first time, that is, even immediately after the seal 30 is removed. Almost at the same time as the developer is sent into the development chamber 9A, it is also sent into the space between the first and second electrodes 81 and 82, changing the electrostatic capacity between the two electrodes.

There are the following four forces which affect the distribution of the developer in the adjacencies of the first and second electrodes 81 and 82:

(1) an upward force which affects the developer as the developer is sent into the development chamber 9A by the developer stirring-conveying member 9*b;*

(2) a downward force which is generated due to the self-weight of the developer;

(3) a force which works against the downward force (when a large amount of developer is present under the recess 80, it functions as a lid which covers the recess

80 from below, preventing the self-weight of the developer from causing the developer to descend from within the recess 80);

(4) a force which results from the low fluidity of the developer itself and works in a manner to hold the developer at its current position.

When there is a sufficient amount of developer within the developer container 11 and development chamber 9A, the force (1) is extremely large, and the force (3) works as the lid for the recess 80, keeping the developer in the recess 80 confined in the recess 80; in other words, a state in which developer remains packed between the first and second electrodes 81 and 82 is maintained, and therefore, a high electrostatic capacity value is continuously shown.

As the usage of the process cartridge B continues, the amount of the developer in the adjacencies of the development roller 9*a* decreases due to the developer consumption for development. However, the adjacencies of the development roller 9*a* are continuously replenished with the developer from the developer container 11 by the function of the developer stirring-conveying member 9*b*. Thus, with the continuous usage of the process cartridge B, the amount of the developer within the developer container 11 decreases, and the top surface of the developer mass within the developer container 11 descends.

Figure 7:
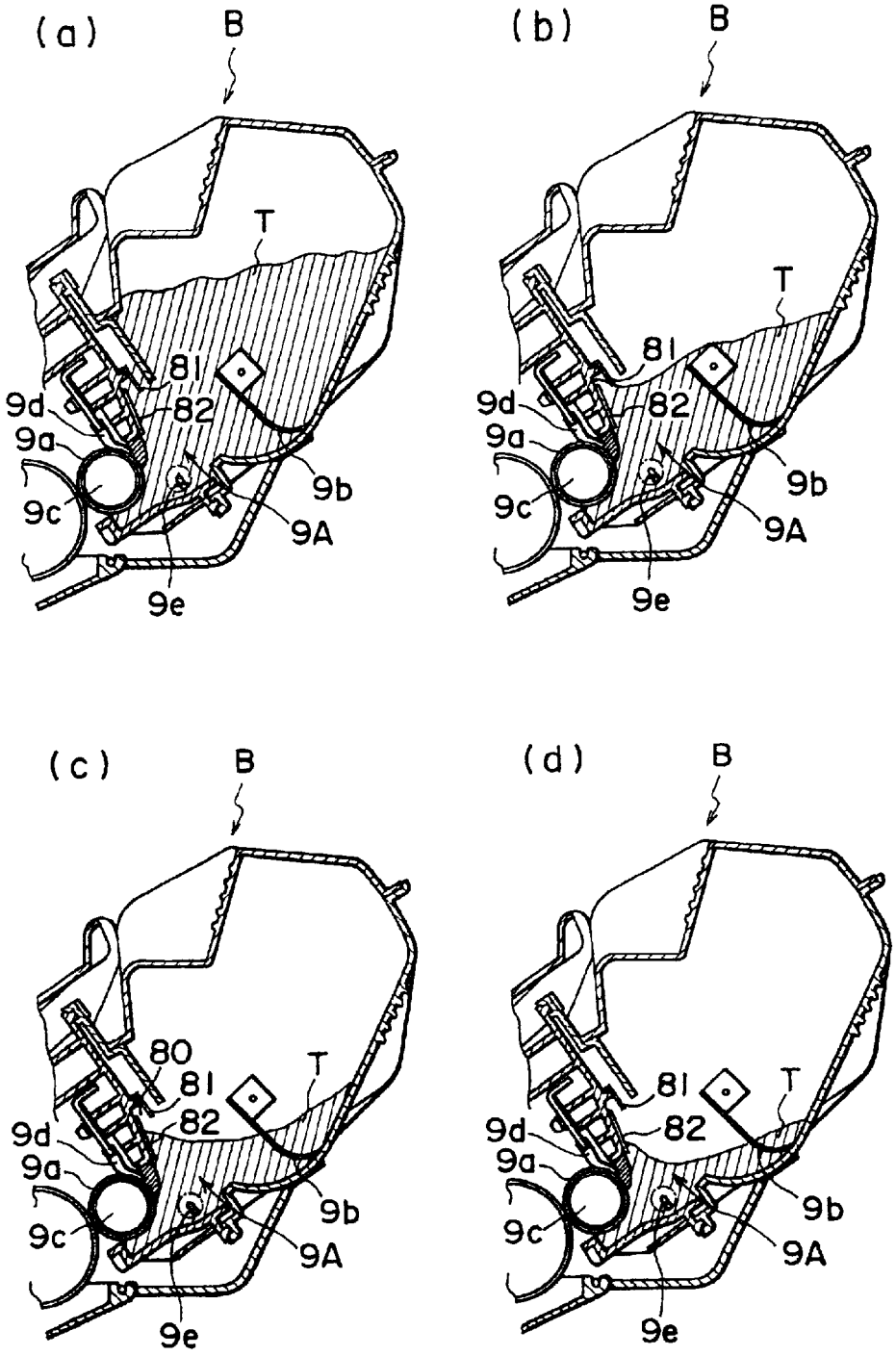
FIG. 7 is an illustration of a positional relationship between the reduction of the amount of the developer and the first and second electrodes with the consumption of the developer.

Referring to FIG. 7, as the top surface of the developer mass within the developer container 11 descends in the order indicated by FIGS. 7(*a*), 7(*b*), 7(*c*), and 7(*d*), the forces (1) and (3) decrease, allowing the amount of the developer between the first and second electrodes 81 and 82 to gradually decrease. As a result, the electrostatic capacity between the two electrodes changes.

Describing further FIG. 7, FIG. 7(*a*) shows a state of the interior of the developer container 11 when a sufficient amount of developer is present in the developer container 11, and the first and second electrodes 81 and 82 are within the developer mass. FIG. 7(*b*) shows a state of the interior of the developer container 11 when the amount of the developer within the developer container 11 has slightly decreased, and the top surface of the developer mass within the developer container 11 has descended to the same level as those of the bottom and top ends of the first and second electrodes 81 and 82, respectively. FIG. 7(*c*) shows the a state of the interior of the developer container 11 when the amount of the developer has further decreased to a level at which there is no developer in the recess 80, and the surface of the developer mass within the developer container 11 has dropped below the level of the bottom end of the first electrode 81, being approximately at the level of the center of the second electrode 82. FIG. 7(*d*) shows a state of the interior of the developer container 11 when the amount of the developer in the developer container 11 has decreased to a level at which the top surface of the developer mass within the developer container 11 barely touches the bottom end of the second electrode 82.

The manner in which the electrostatic capacity value between the two electrodes 81 and 82 changes in response to the surface of the developer mass position (amount of developer remainder) within the developer container 11 is affected by the fluidity of the developer in use and the conveying performance of the developer stirring conveying member 9*b*.

For example, when the developer has such fluidity as that of water, the position of the top surface of the developer mass in the developer container 11 perfectly coincides with the position of the top surface of the developer mass between the first and second electrodes 81 and 82. However, the actual fluidity of the developer is far lower than the fluidity of water, and therefore, even after a certain amount of the developer was conveyed into the development chamber 9A by the developer stirring-conveying member 9*b*, the top surface of the developer mass remains as it was prior to the conveyance of the developer into the development chamber 9A. Therefore, the position of the top surface of the developer mass between the first and second electrodes 81 and 82 also tends to change slightly behind the change in the position of the top surface of the developer mass in the developer container 11 as shown by FIGS. 7(*a*)–7(*d*).

The manner in which developer enters between the first and second electrodes 81 and 82 is affected by the performance of the developer stirring-conveying member 9*b*. In other words, if the conveying performance of the developer stirring-conveying member 9*b* is either excessively strong or excessively weak, the relationship between the change in the amount of the developer in the developer container 11 and the change in the value of the electrostatic capacity between the two electrodes 81 and 82 deviates Therefore, the positions and shapes of the first and second electrodes 81 and 82 must be optimized according to the fluidity of the developer and the developer conveyance performance of the developer stirring-conveying member 9*b*.

As described above, the electrostatic capacity between the first and second electrodes 81 and 82 changes in response to the developer distribution in the regions which affect the sensitivities of the first and second electrodes, that is, the toner distribution in the recess 80 and the adjacencies thereof. However, the developer within the recess 80 remains under the above described various forces (1)–(4), and therefore, there is a tendency that the value of the electrostatic capacity does not stabilize until the aforementioned four forces reach virtual equilibrium. In other words, the value of this electrostatic capacity between the two electrodes 81 and 82 shows some deviations if the developer temporarily enters the aforementioned regions by an excessive amount, or if the entrance of the developer into the aforementioned regions lags.

Figure 8:
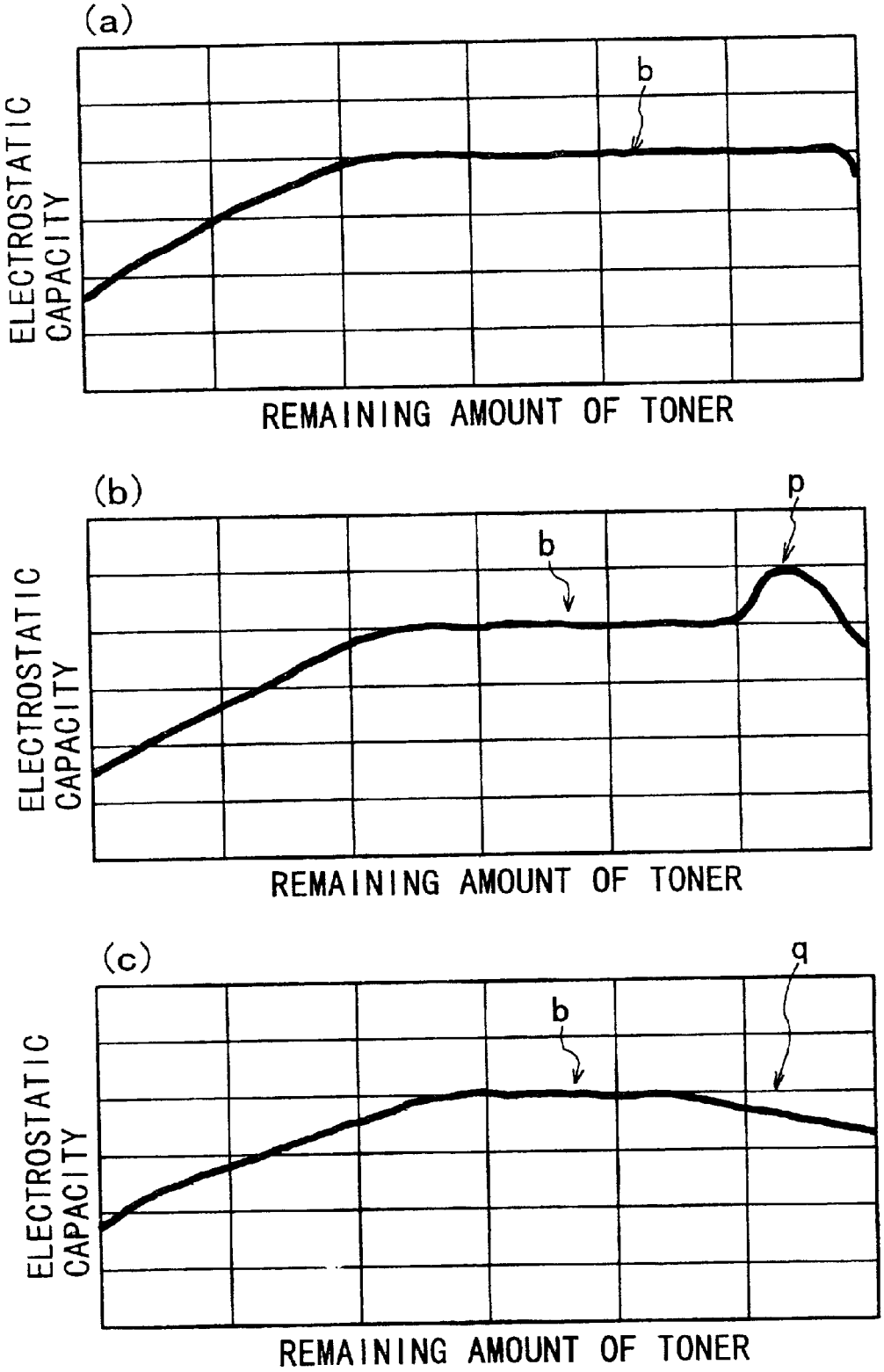
FIG. 8 shows a relationship between the amount of the toner and the electrostatic capacity in the developer amount detecting means according to an embodiment of the present invention, wherein (a) shows a normal state, (b) shows too much developer in the recess, and (c) shows too long a period of time required for the developer to enter the recess.

The graph in FIG. 8 shows the relationship between the amount of the developer remaining in the adjacencies of the first and second electrodes 81 and 82, and the corresponding electrostatic capacity between the first and second electrodes 81 and 82, during a period in which a given amount of developer was supplied to the adjacencies of the two electrodes 81 and 82 and was completely consumed. FIG. 8(*b*) shows a case in which an excessive amount of developer entered the regions in which the amount of developer affects the sensitivities of the first and second electrodes 81 and 82, and FIG. 8(*c*) shows a case in which the developer entrance into the above described regions lagged. FIG. 8(*a*) shows the normal case, or the normal changes.

When an excessive amount of developer entered the aforementioned particular regions, the electrostatic capacity value suddenly increased as represented by a point indicated by a referential code p in FIG. 8(*b*), whereas when the developer entrance into the regions lagged, it took a certain length of time for the electrostatic capacity value to reach its equilibrium level as represented by a range indicated by a referential code q in FIG. 8(*c*).

One of the means for solving this problem is to reduce the dimension of the recess 80 in terms of the direction in which developer is conveyed; more specifically, the dimension of the recess 80 in terms of the developer conveyance direction should be reduced by shortening the first electrode 81, that is, the electrode having a greater distance from the development roller 9*a*, in such a manner that the position of the bottom end of the first electrode 81 moves upward. However, if the first electrode 81 is shortened by more than a certain length, the surface area of the condenser made up of the first and second electrodes 81 and 82 becomes too small to provide the condenser with a satisfactory amount of sensitivity. Therefore, the electrode 81 requires a proper length.

On the other hand, if the second electrode 82, that is, the electrode having a shorter distance from the development roller 9*a*, is extended so that its top end reaches the level of the top end of the recess 80, the distance between the first and second electrodes 81 and 82 within the recess 80 becomes too small, that is, small enough to raise the sensitivity of the aforementioned condenser to a level at which the condenser is capable of detecting the aforementioned fluctuation of the electrostatic capacity value, which occurs while the state of developer mass becomes stabilized. Therefore, the developer amount may not be accurately detected. Thus, it is not desirable to extend the second electrode 82 in the manner described above.

Figure 9:
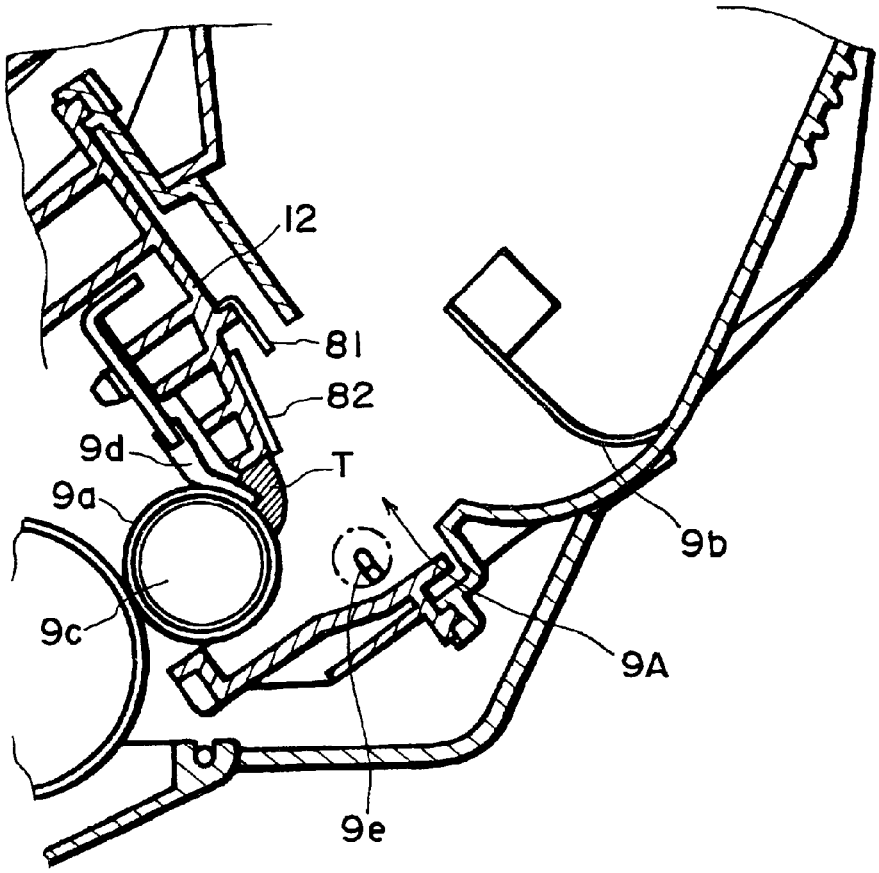
FIG. 9 shows an example in which the second electrodes is cut so as not to be opposed to the recess.

Referring to FIG. 9, the sensitivity of the aforementioned condenser to the electrostatic capacity can be controlled by shortening the second electrode 82 itself by cutting off the portion of the second electrode 82 corresponding to the recess 80, more specifically, by shortening the second electrode 82 so that the position of the top end of the second electrode 82 falls below the level of the bottom end of the first electrode 81, in other words, so that after the proper mounting of the process cartridge B or the developing apparatus 9 into the electrophotographic image forming apparatus main assembly, at least the bottom end of the first electrode 81 would be above the level of the second electrode 82. Incidentally, the excessive shortening of the second electrode 82 creates a problem, that is, insufficient sensitivity. Therefore, the second electrode 82 must be cut to a proper length. In this embodiment, the first and second electrodes 81 and 82 are in the form of a plate, and the dimension of the first electrode 81 in terms of the direction perpendicular to the longitudinal direction of the development roller 9*a* is greater than that of the second electrode 82.

In addition to the detecting method employing the above described structural arrangement, there are other detecting methods; for example, if a process cartridge is provided with a recording means, it is possible to record the print count, the duration of the process cartridge, and the like, so that the detection can be started for the first time after the elapse of a certain length of time which is thought to be needed for the aforementioned equilibrium to be realized.

Figure 10:
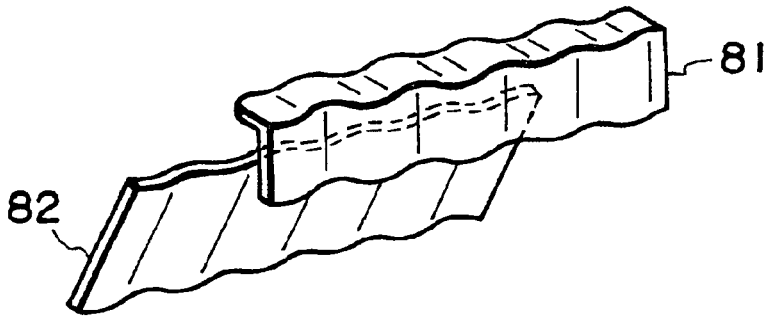
FIG. 10 is a perspective view of first and second electrodes according to an embodiment of the present invention.
Figure 11:
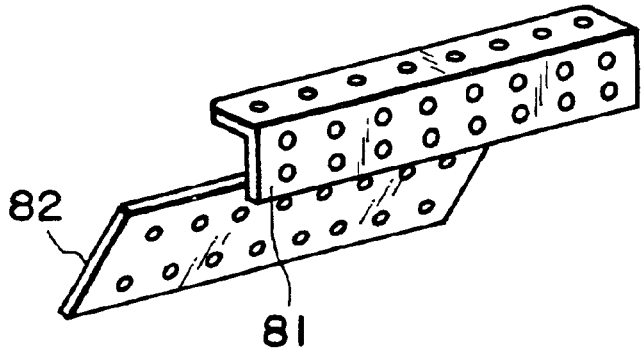
FIG. 11 is a perspective view of first and second electrodes according to another embodiment of the present invention.

It is desired to improve the accuracy with which the developer remainder amount is continuously detected to increase the amount of the change in the electrostatic capacity. More specifically, this objective can be accomplished by increasing the surface areas of the first and second electrodes 81 and 82, by reducing the distance between the first and second electrodes 81 and 82, and/or by the like methods. In order to increase the surface areas of the electrodes, the electrodes may be corrugated as shown in FIG. 10, or may be dimpled as shown in FIG. 11.

Figure 12:
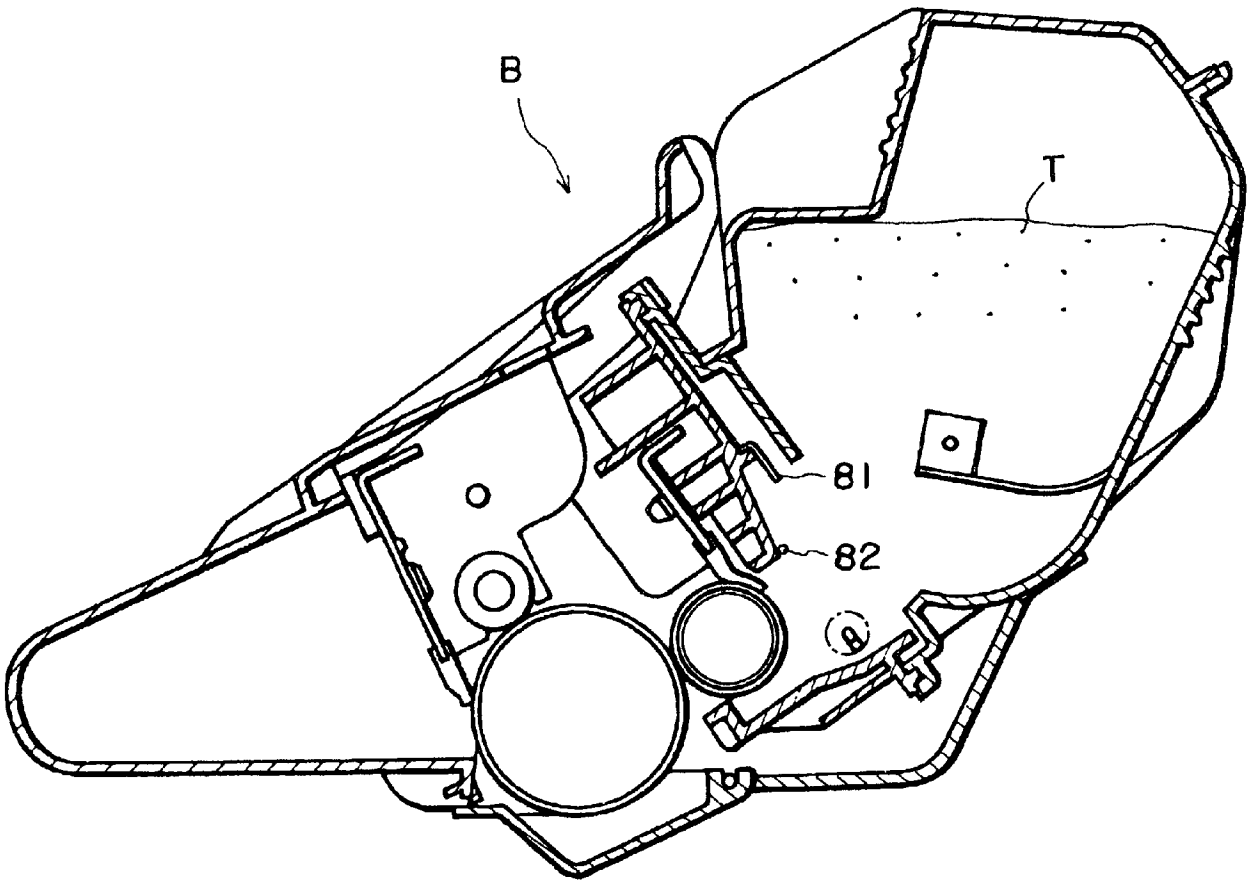
FIG. 12 is a longitudinal sectional view of a process cartridge according to another embodiment of the present invention.
Figure 13:
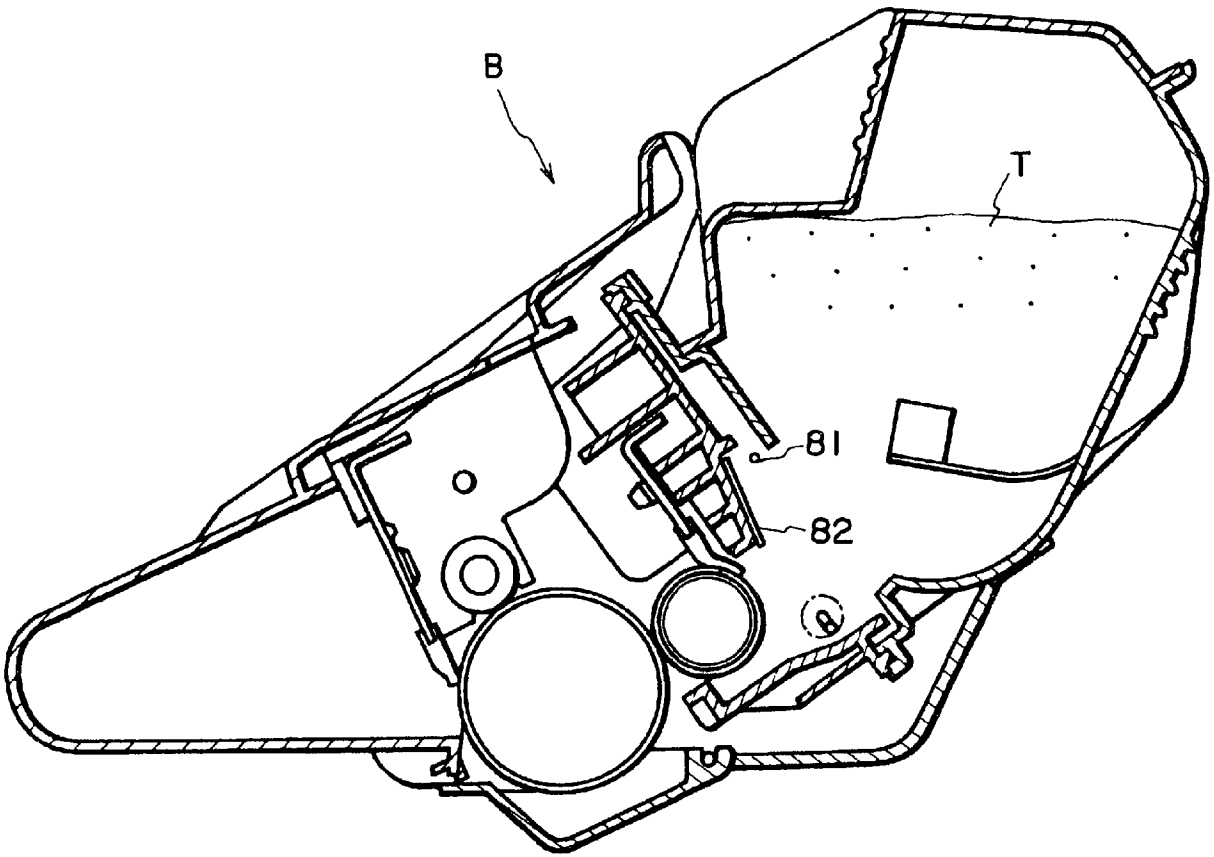
FIG. 13 is a longitudinal sectional view of a process cartridge according to a further embodiment of the present invention.

Incidentally, if restrictions in cartridge design make it impossible to secure a space large enough for such electrodes as those described above, or if it is necessary to reduce process cartridge cost, one of the first and second electrodes 81 and 82 may be formed of a piece of round rod as shown in FIGS. 12 and 13.

Next, referring to FIGS. 14 and 15, positioning of the electrodes in terms of the longitudinal direction of the developer roller 9*a* will be described.

Figure 14:
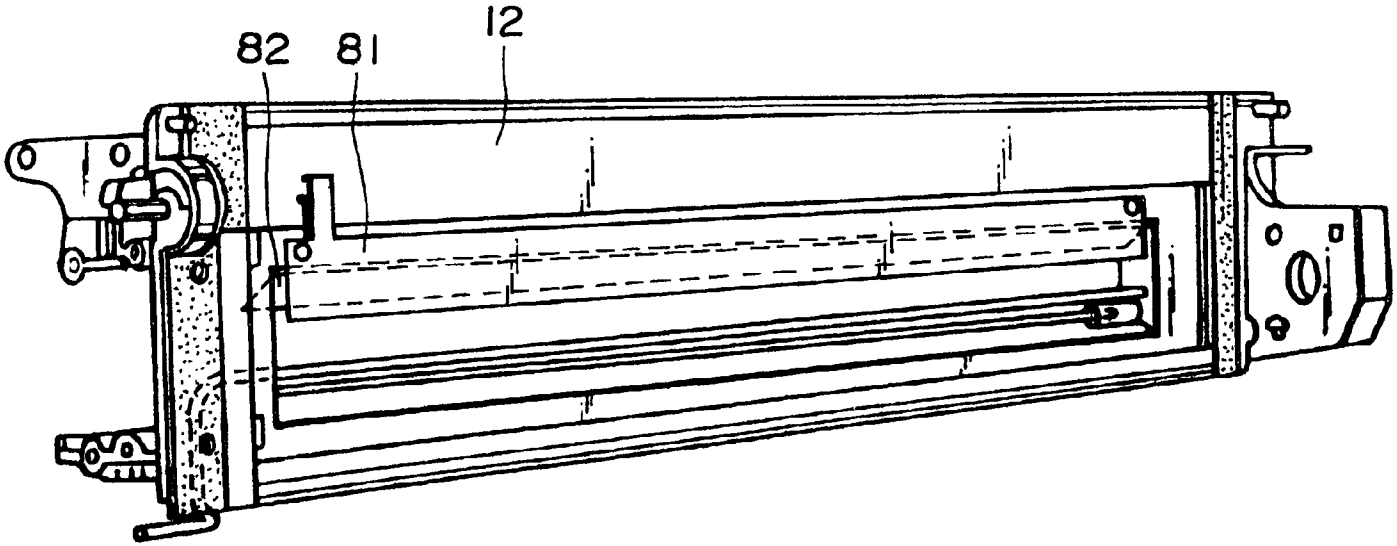
FIG. 14 is a perspective view of first and second electrodes disposed in a developer chamber according to another embodiment of the present invention.
Figure 15:
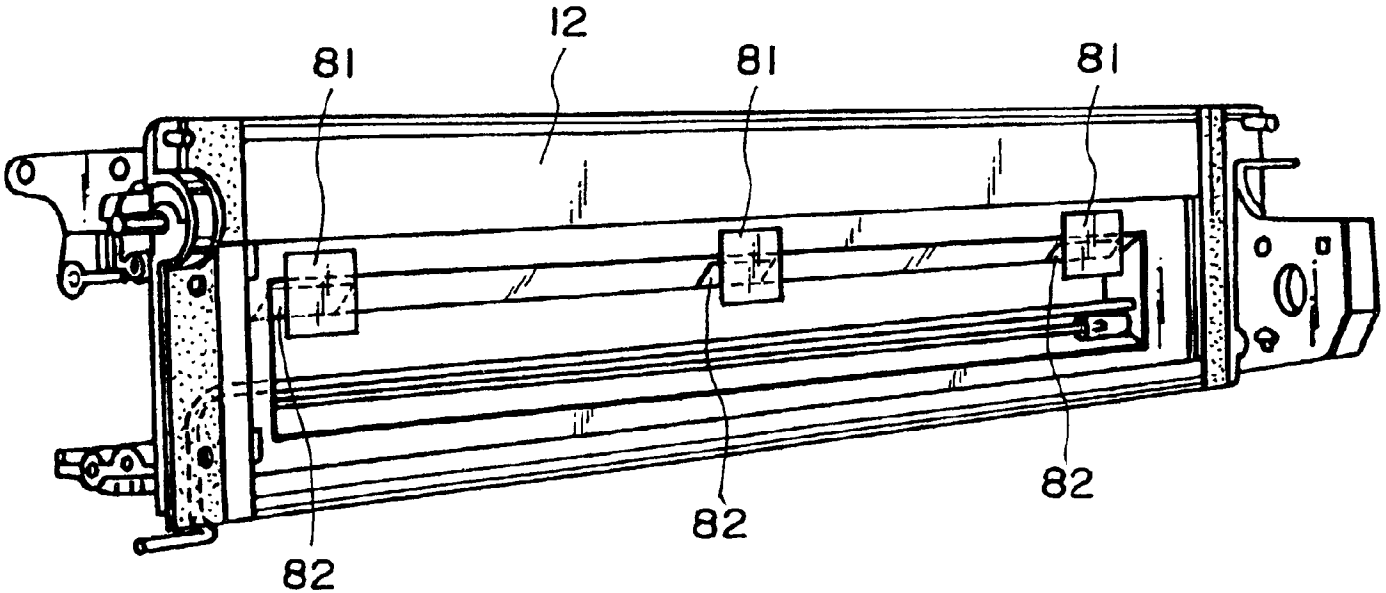
FIG. 15 is a perspective view of first and second electrodes disposed in a developer chamber according to a further embodiment of the present invention.

Referring to FIG. 14, the detection accuracy can be improved by making the dimensions of the first and second electrodes 81 and 82 in terms of the longitudinal direction of the developer roller 9*a* virtually the same as the dimension of the image forming region in terms of the longitudinal direction. However, if the detection accuracy is less essential, electrodes smaller in dimension in terms of the longitudinal direction of the development roller 9*a* may be placed across the center or end portion of the image forming region to reduce the cost. In such a case, however, it is impossible to detect the developer distribution in terms of the longitudinal direction of the development roller 9*a*, and therefore, in order to compensate for such a problem, it is desired that a plurality of electrodes smaller in the dimension in terms of the longitudinal direction of development roller 9*a* are strategically distributed across the image forming region, for example, at both ends, the center and the like, as shown in FIG. 15.

As image formation continues, developer consumption progresses. Eventually, the developer between the longitudinal edge of the development blade 9*d* for regulating the developer amount on the peripheral surface of the development roller 9*a*, and the second electrode 82, that is, the developer between the development roller 9*a* and second electrode 82, is consumed, and thereafter, images with abnormal white spots are produced, signaling the developer depletion, or "no developer condition".

Figure 16:
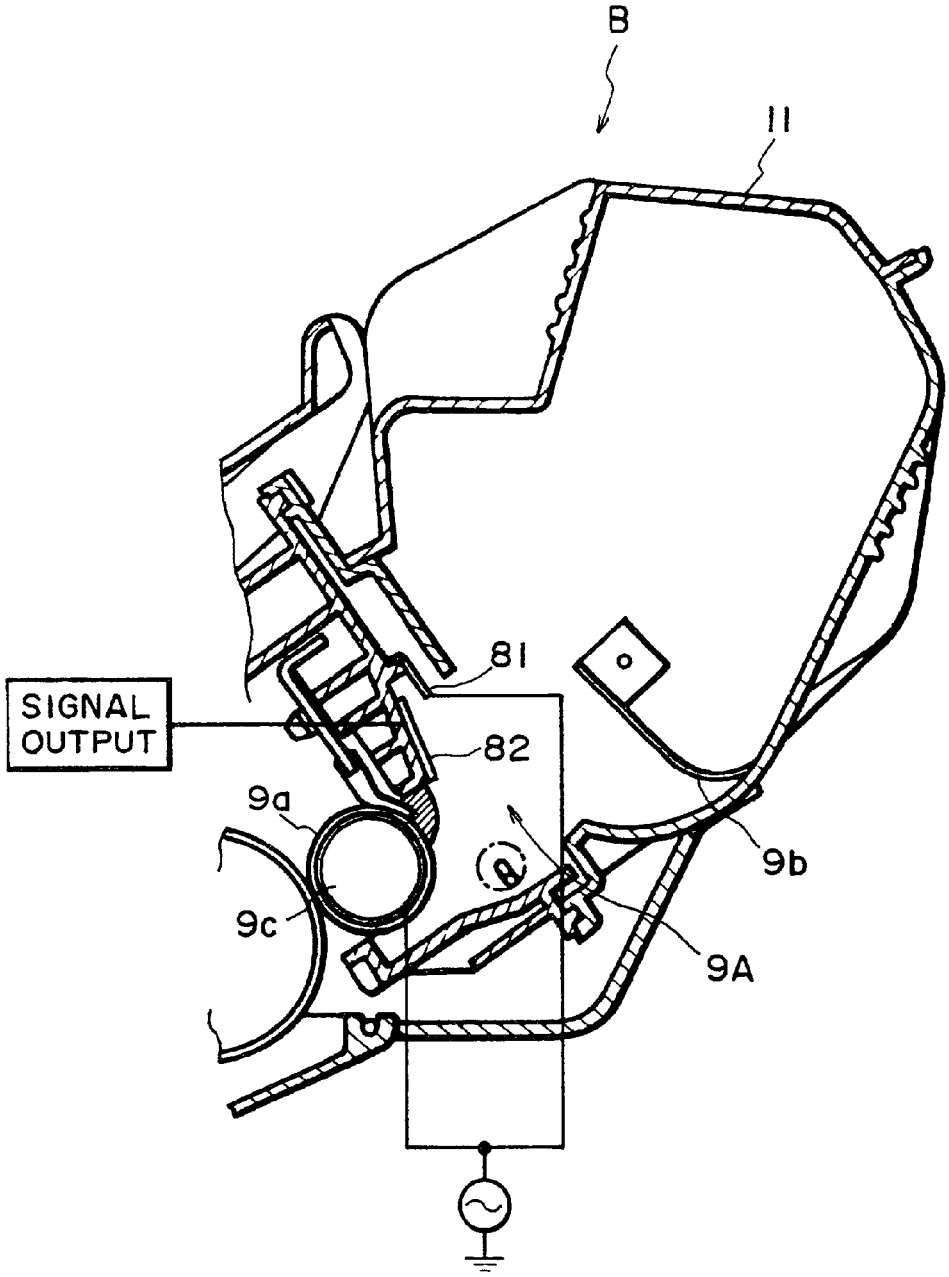
FIG. 16 shows an electric circuit for first and second electrodes and a developing roller.

The accuracy with which the developer level below which an image with abnormal white spots is produced is detected, can be drastically improved by electrically connecting the development roller 9*a* in such a manner as to create another condenser in which the development roller 9*a* functions as one of the electrodes (counterpart is the second electrode 82) and which is connected in parallel to the aforementioned condenser constituted of the first and second electrodes 81 and 82, as shown in FIG. 16.

Figure 17:
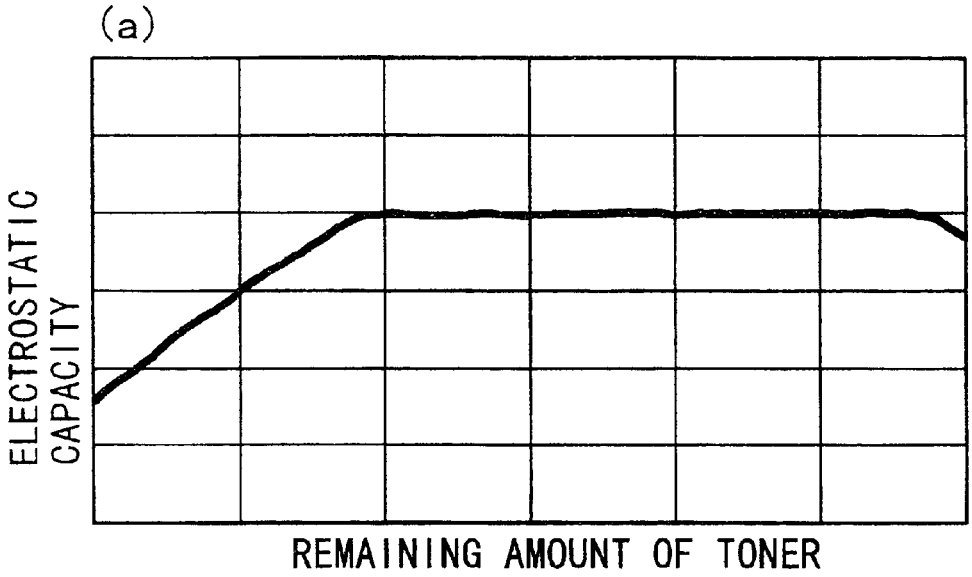
FIG. 17 illustrates changes in the amount of the toner and the electrostatic capacity (a) when a developing member is not used as a capacitor, and (b) when it is used as a capacitor.
Figure 17:
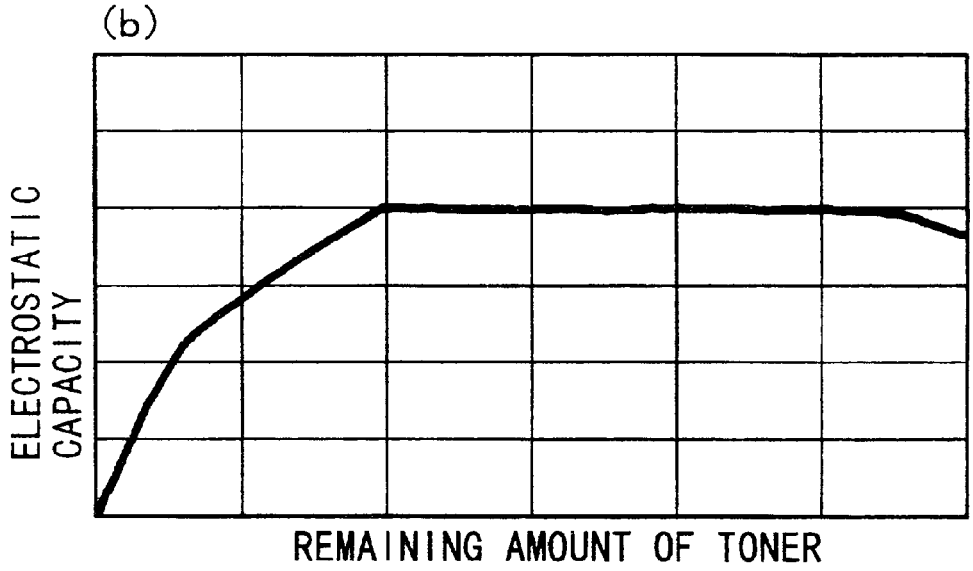

FIG. 17 shows typical changes in electrostatic capacity; FIGS. 17(*b*) and 17(*a*) show the cases in which the development roller 9*a* was caused to, and not caused to, double as one of the condenser electrodes, respectively. It is evident that the magnitude of the change in the electrostatic capacity, which occurs in response to the change (amount of consumption) in the amount of toner in terms of a toner unit as the developer remainder amount nearly decreases to the level at which the formation of an image with abnormal white spots begins, was far greater, in other words, the detection accuracy was far better, in the case represented by FIG. 17(*b*) than that in the case represented by FIG. 17(*a*).

The reason for the occurrence of a larger change in the electrostatic capacity relative to the change (consumption) in the toner amount in terms of the toner unit, immediately before the beginning of the period in which images with abnormal white spots occur, is that the abnormal white spots begin to be created as the amount of the toner on the peripheral surface of the development roller 9*a* begins to decrease. Therefore, measuring the amount of the developer on the peripheral surface of the development roller 9*a* as accurately as possible is one of the essential requirements for improving the detection accuracy.

It becomes possible to raise the "detection sensitivity" in the adjacencies of the development roller 9*a* by making the above described structural arrangement, in which the development roller 9*a* is made to double as one of the pair of electrodes in the aforementioned second condenser, while placing the second electrode 82, which functions as the counterpart to the development roller 9*a*, in the adjacencies of the development roller 9*a*. The difference in detection accuracy between FIGS. 17(*a*) and 17*fb*) was created by such a structural arrangement.

Further, in order to improve the accuracy with which the threshold developer level below which images with abnormal white spots are produced, it is necessary to improve "detection sensitivity" in the adjacencies of the peripheral surface of the development roller 9*a*.

Figure 18:
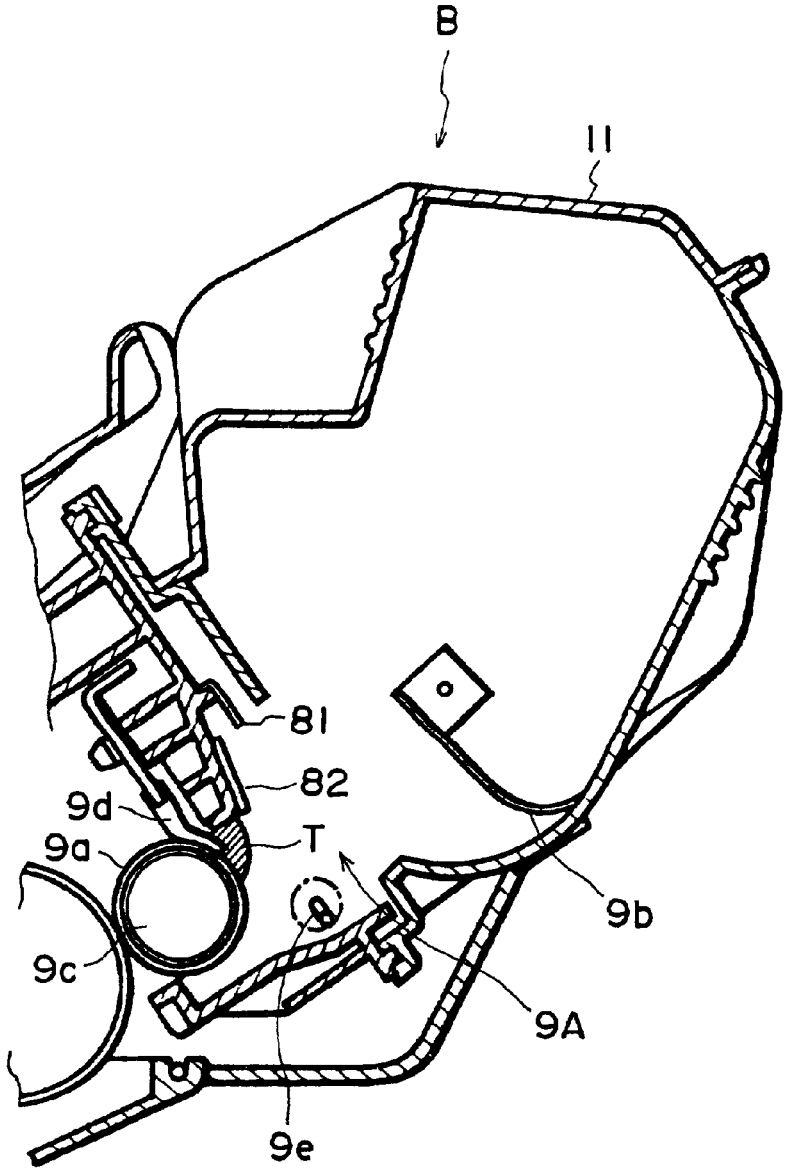
FIG. 18 shows a state in which the developer is present only adjacent a developing blade.

Even when there is almost no developer on the peripheral surface of the development roller 9*a*, development is possible as long as developer is present in the adjacencies of the development blade 9*d* as is represented by the developer T in FIG. 18. Therefore, the accuracy, with which the threshold developer level below which images with abnormal white spots is detected, can be improved by improving the sensitivity with which the developer T in the above described region is detected.

Figure 19:
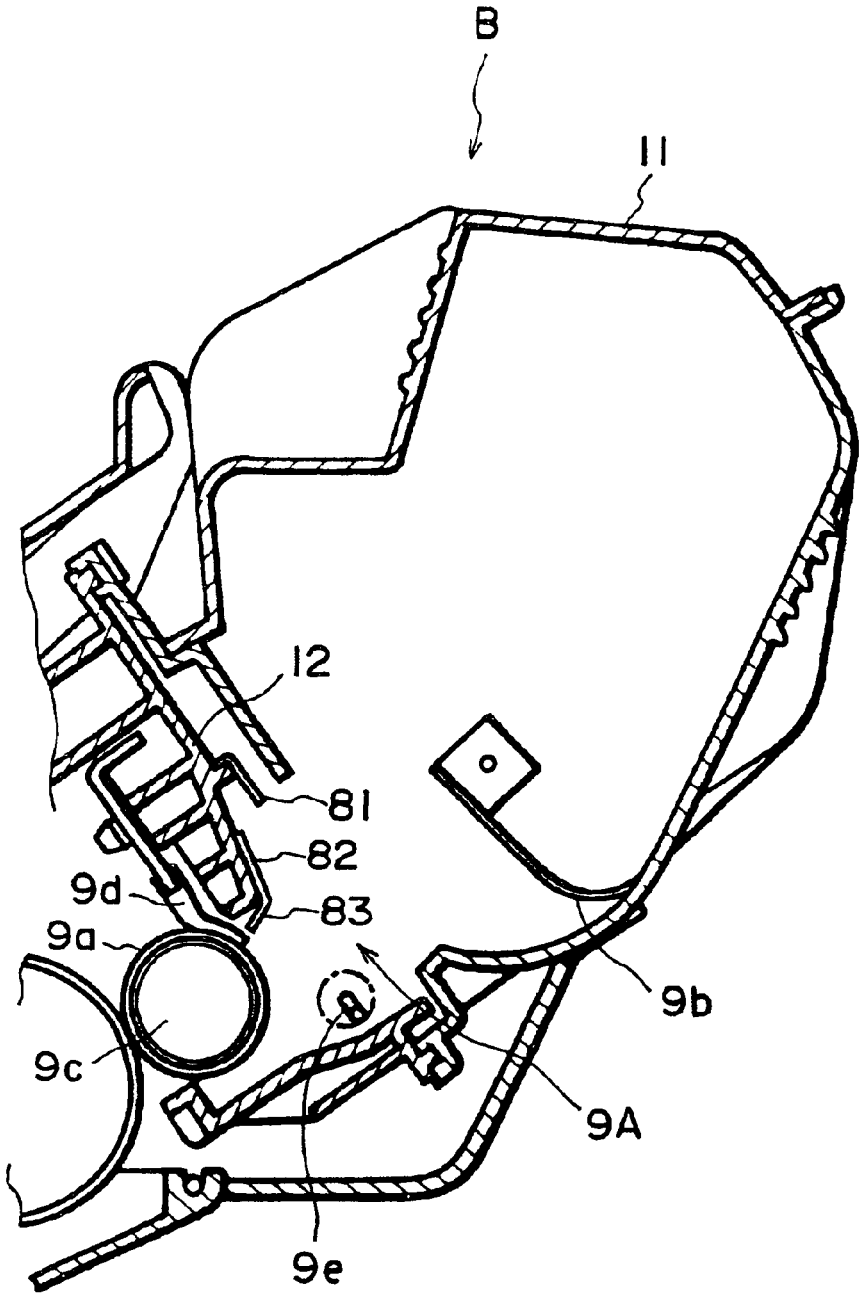
FIG. 19 is a longitudinal sectional view of a major part of an extended bent portion of the second electrodes.

Thus, in this embodiment, a third electrode 83 was provided, which was placed close to the longitudinal edge of the development blade 9*d* and extended in parallel to the development roller 9*a* as shown in FIG. 19. More specifically, the third electrode 83 was added as an extension of the second electrode 82, being bent toward the development blade 9*d*. As a result, the accuracy with which the threshold developer level was detected was further improved.

The above described third electrode 83 does not need to be a part of the second electrode 82. In other words, even if the third electrode 83 is independent from the second electrode 82, it does not matter as far as the threshold developer level detection accuracy is concerned. In such a case, the third electrode 83 may be constituted of a piece of a round rod instead of a piece of a metallic plate.

Further, when the third electrode 83 (portion angled relative to electrode 82) is formed as an electrode independent from the second electrode 82, there is a possibility that not only is the third electrode 83 used as a part of the means for continuously detecting developer remainder amount, but also can be used as a part of a means for highly accurately detecting the presence (absence) of developer.

As described above, the developer amount in the development chamber 9A is estimated by measuring the developer amount between the first and second electrodes 81 and 82, and the developer amount between the first and second electrode 61 and 82 can be measured by continuously detecting the electrostatic capacity between the first and second electrodes 81 and 82.

Further, the accuracy with which the threshold developer level below which images with abnormal white spots are formed is detected can be improved by providing the third electrode 83 as an integral part of the second electrode 82 and using the development roller 9*a* as the counterpart to the third electrode 83 which makes up the additional condenser with the development roller 9*a*.

In order to detect the developer remainder amount from the early stage of process cartridge usage, it is necessary to place a detecting means on the developer container side. On the other hand, in order to accurately detect the threshold developer level below which images with abnormal white spots are produced, it is necessary to place a detecting means in the adjacencies of the development roller 9*a*. Being able to satisfy these two mutually contradicting requirements with the provision of only a single detecting means characterizes this embodiment of the present invention. In other words, according to this embodiment, a detecting means is placed in the adjacencies of the development roller in such a manner that the detecting means is enabled to sense the change in the height of the developer mass. In other words, one of the essential characteristics of the process cartridge structure in this embodiment is that the developer amount within the developer container can be determined on the basis of the information regarding the developer sent by the developer stirring-conveying member 9*b* from the developer container 11.

The provision of the above described structure made it possible to continuously detect the developer remainder amount while maintaining a high degree of accuracy in detecting the threshold developer level below which images with abnormal white spots are produced. Further, the above described two mutually contradicting requirements were satisfied with the provision of only a single detecting means, and therefore, cost was reduced.

As for the electrode material, as long as the electrodes 81, 82, and 83 are formed of an electrically conductive substance, their functions remain similar to those described above. However, in this embodiment, a nonmagnetic metallic substance, for example, nonmagnetic SUS, was used as the electrode material to prevent the electrodes from interfering with developer circulation.

Further, if the electrodes 81, 82, and 83 are directly attached to the frame portion 12, which constitutes the wall of the development chamber 9A, by deposition or printing, for example, or if they are built into the frame portion 12 with the use of two color molding along with electrically conductive resin, the number of problems resulting from the electrode attachment errors and electrode specification errors will be much smaller; in other words, they will be attached to the frame portion 12 with a higher degree of accuracy.

In the above, this embodiment was described with reference to the structure of the process cartridge in which the amount of magnetic developer was continuously detected. However, this embodiment is also applicable to the structure of a developer container for containing on magnetic developer.

Figure 20:
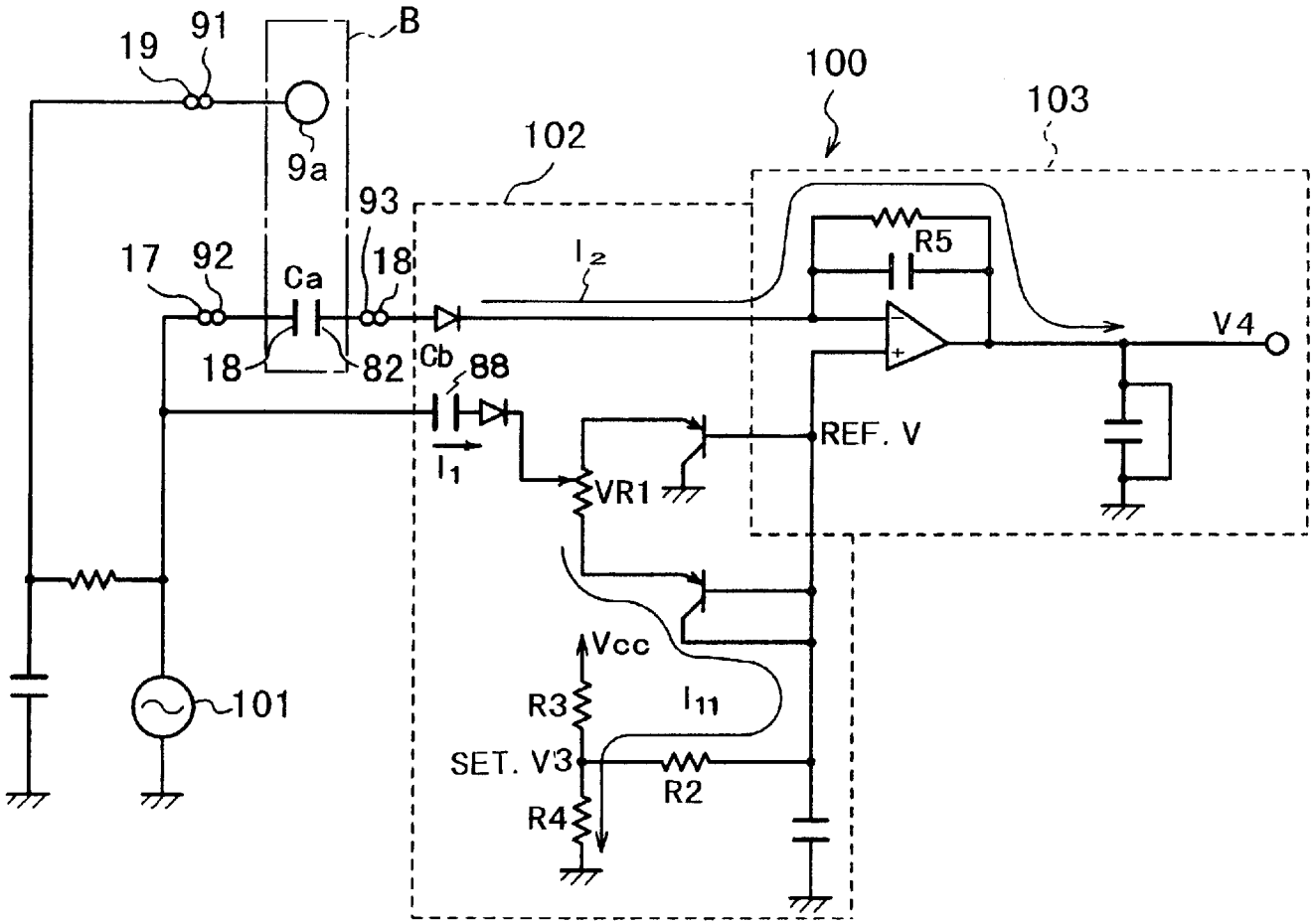
FIG. 20 shows an electric circuit for the developer amount detecting divides according to an embodiment of the present invention.

Next, referring to FIG. 20, a developer amount detecting apparatus as an embodiment of the principle of the present invention will be described. FIG. 20 shows how the developer roller 9*a* and the first and second electrodes 81 and 82 within the process cartridge B are connected to a developer amount detection circuit 100 on the image forming apparatus main assembly side.

The first electrode 81 and development roller 9*a* are connected to a development bias circuit 101 as a development bias applying means through a first contact point 92 (contact point 17 on the apparatus main assembly side) and a second contact point 91 (contact point 19 on the apparatus main assembly side), respectively. Among the electrodes on the measuring side, the second electrode 82 or the output electrode is connected to a control circuit 102 through a third contact point 93 (contact point 18 on the main assembly side). The third electrode 83 is provided as an integral part of the second electrode 82 as described above, although it is not illustrated in the drawing.

The development bias circuit 101 is connected to a reference capacity member 88 of the control circuit 102. A reference voltage V1 for detecting the developer remainder amount is set using an AC current I1 supplied from the development bias circuit 101.

The control circuit 102 sets the reference voltage V1 by adding a voltage drop V2 caused by the combination of an AC current I11 created by shunting the AC current I1 supplied to the reference capacity member 88, that is, an impedance element, at a volume VR1, and a resistor R2, to a voltage V3 set by resistors R3 and R4.

Therefore, an AC current 12 supplied to the first and second electrodes 81 and 82, or the electrodes on the measuring side, is inputted to an amplification circuit 103, from which it is outputted as a voltage V4 (V1−12×R5), the value of which represents the developer remainder amount. In other words, the value of this output voltage is used as a value which represents the developer remainder amount.

According to the electrophotographic image forming apparatus in this embodiment, the developer amount between the first and second electrodes is continuously detected as described above, and the amount of the developer consumption is displayed on the basis of the detected information, so that a user can be prompted to prepare a brand-new process cartridge or a developer replenishment cartridge. Further, the developer amount between the third electrode and developing member is detected, and the highly precise time at which developer depletion occurs is displayed on the basis of the detected information, so that a user can be prompted to replenish the process cartridge with developer. Incidentally, in this embodiment, the side from which voltage was applied comprised the development roller and first electrode, and the side from which signals were detected comprised the second and third electrodes. However, the same effects as those described above can be obtained even if the side from which voltage is applied comprises the development roller and second electrode, and the side from which signals are detected comprises the first and third electrodes.

It is difficult to design a process cartridge in which a pair of electrically conductive members are positioned inside the developer container, because such a design affords only a small amount of latitude in terms of the location, the shape, and the size of the conductive members. However, such a design makes it possible to reduce the distance between the pair of electrodes to a level which the conventional structural arrangement cannot match. Further, such a design makes it possible to place the pair of electrically conductive members in the adjacencies of the developing member, and therefore, it can improve the accuracy with which the threshold developer level below which images with abnormal white spots are formed is detected.

Figure 21:
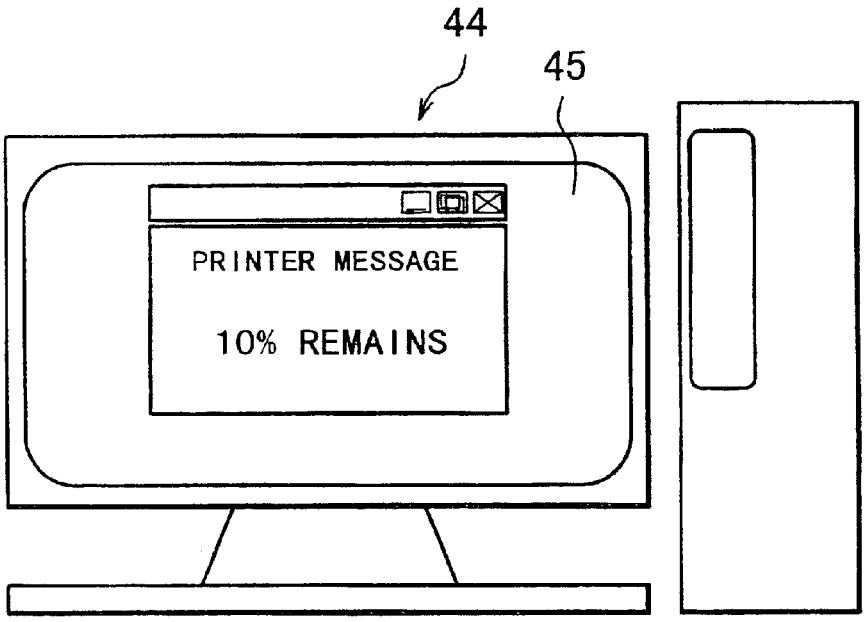
FIG. 21 shows an example of the display of the amount of the remaining developer.
Figure 22:
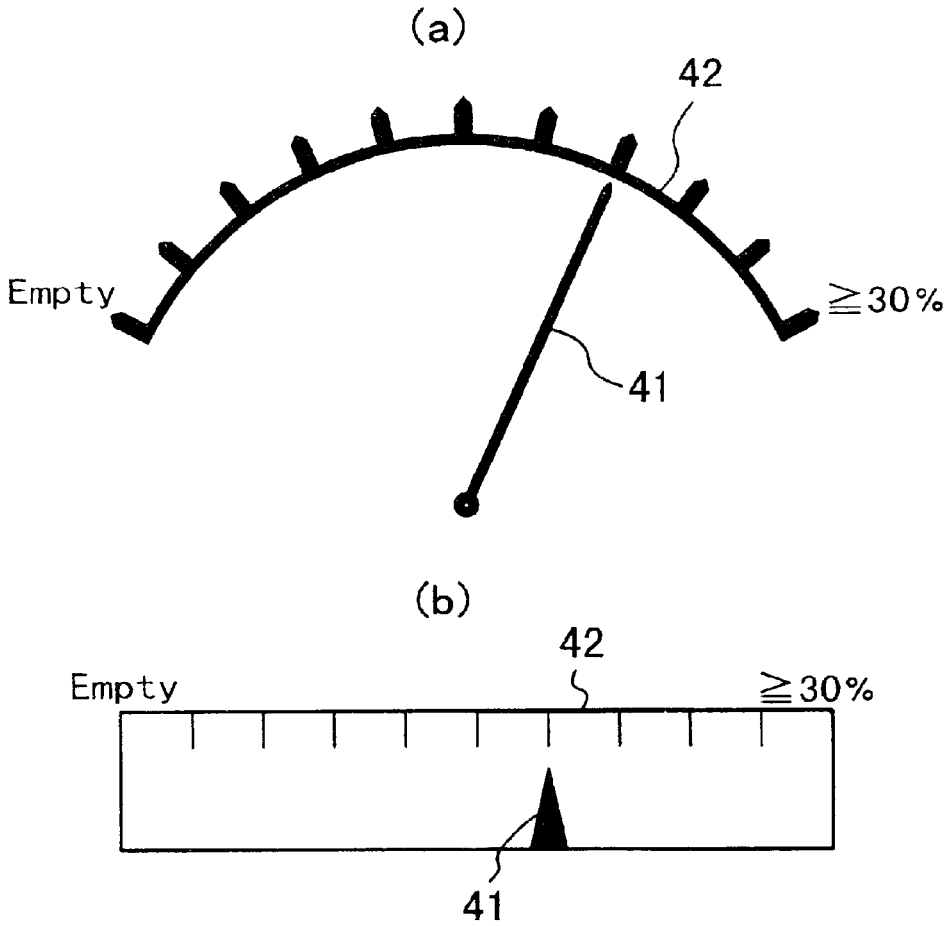
FIG. 22 shows another example of the display of the amount of the remaining developer.
Figure 23:
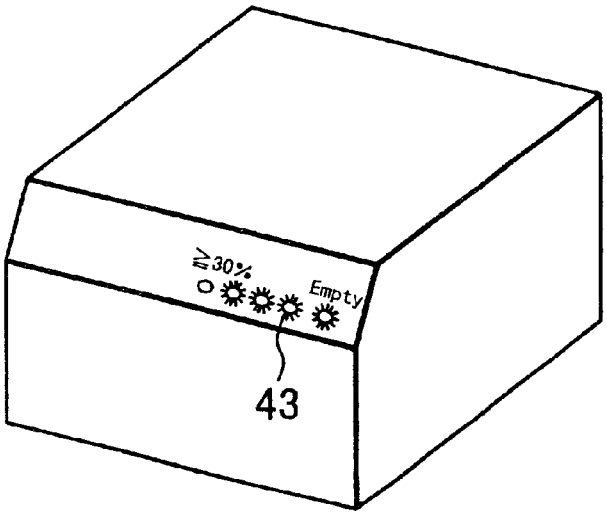
FIG. 23 shows a further example of the display of the amount of the remaining developer.

To describe the method for displaying the developer remainder amount, for example, there are a method in which the information detected by the above described developer amount detecting apparatus is directly displayed in the form of numerical value (for example, "10%") on the screen 45 of a monitor of a personal computer 44 of a user as shown in FIG. 21, or the methods illustrated in FIGS. 22(*a*) and 22(*b*). In the cases of the methods illustrated in FIGS. 22(*a*) and 22(*b*), a user is informed of the developer remainder amount by the point of a gauge 42 pointed by a hand 41 which moves in proportion to the developer amount. Also, the electrophotographic image forming apparatus main assembly may be provided with an indicator section 43, which employs LEDs or the like which are turned on or off in a manner to reflect the developer amount.

Embodiment 2

Next, the second embodiment of the present invention will be described with reference to FIGS. 24–28.

The structure and functions of the electrophotographic image forming apparatus in this embodiment are the same as those of the electrophotographic image forming apparatus in the first embodiment, and the components in this embodiment similar to those in the first embodiment are given the same referential codes as those given in the first embodiment. Further, the component arrangement in terms of the longitudinal direction, and the structure in the adjacencies of the electrodes, in this embodiment, which are the duplicates of those in the first embodiment, will not be described here.

Figure 24:
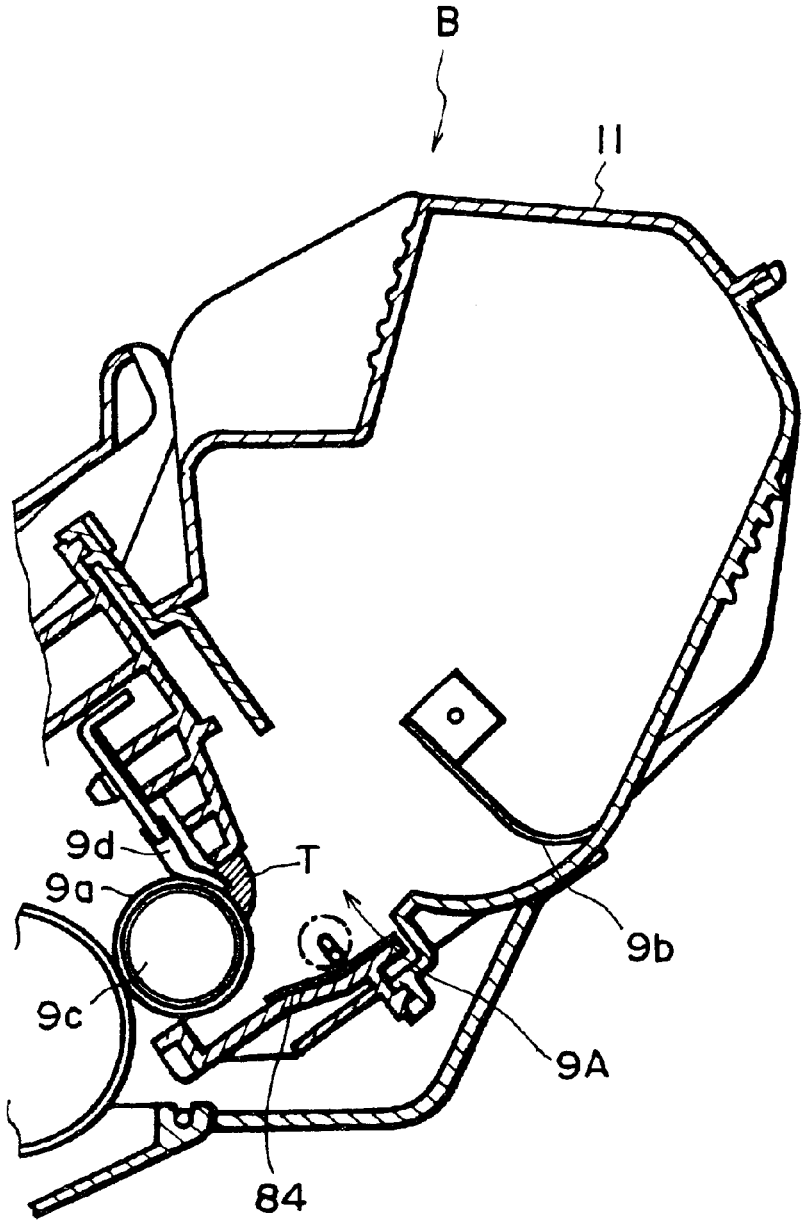
FIG. 24 is a longitudinal sectional view of a further example of the display of the amount of the remaining developer.

Referring to FIG. 24, in this embodiment, an electrode 84 is positioned on the bottom surface of the development chamber 9A. More specifically, the electrode 84 is placed in the path through which the developer T held in the developer container 11 is conveyed to the development roller 9*a*. Thus, hereinafter, this electrode 84 will be referred to as a developer path electrode. This developer path electrode 84 extends across the entire range of the developer path in terms of the longitudinal direction of the development roller 9*a*, and its cross sectional shape shown in FIG. 24 is the same across its entire length.

In this embodiment, the development roller 9*a* is electrically connected to the development bias circuit 101 as shown in FIG. 20 which was previously referred to, and the developer path electrode 84 is connected to the control circuit 102 of the developer amount detection circuit 100.

The magnetic developer in the adjacencies of the bottom surface of the development chamber 9A is always under the influence of the magnetic force generated in the direction to attract the magnetic developer to the development roller 9*a*, by the magnet 9*c* in the development roller 9*a*. Therefore, there is a tendency that as the amount of the developer supplied to the development roller 9*a* decreases due to the reduction in the amount of the developer in the developer container 11, the developer in the adjacencies of the bottom surface of the development chamber 9A is consumed before the developer in the other parts of the development chamber 9A.

Figure 26:
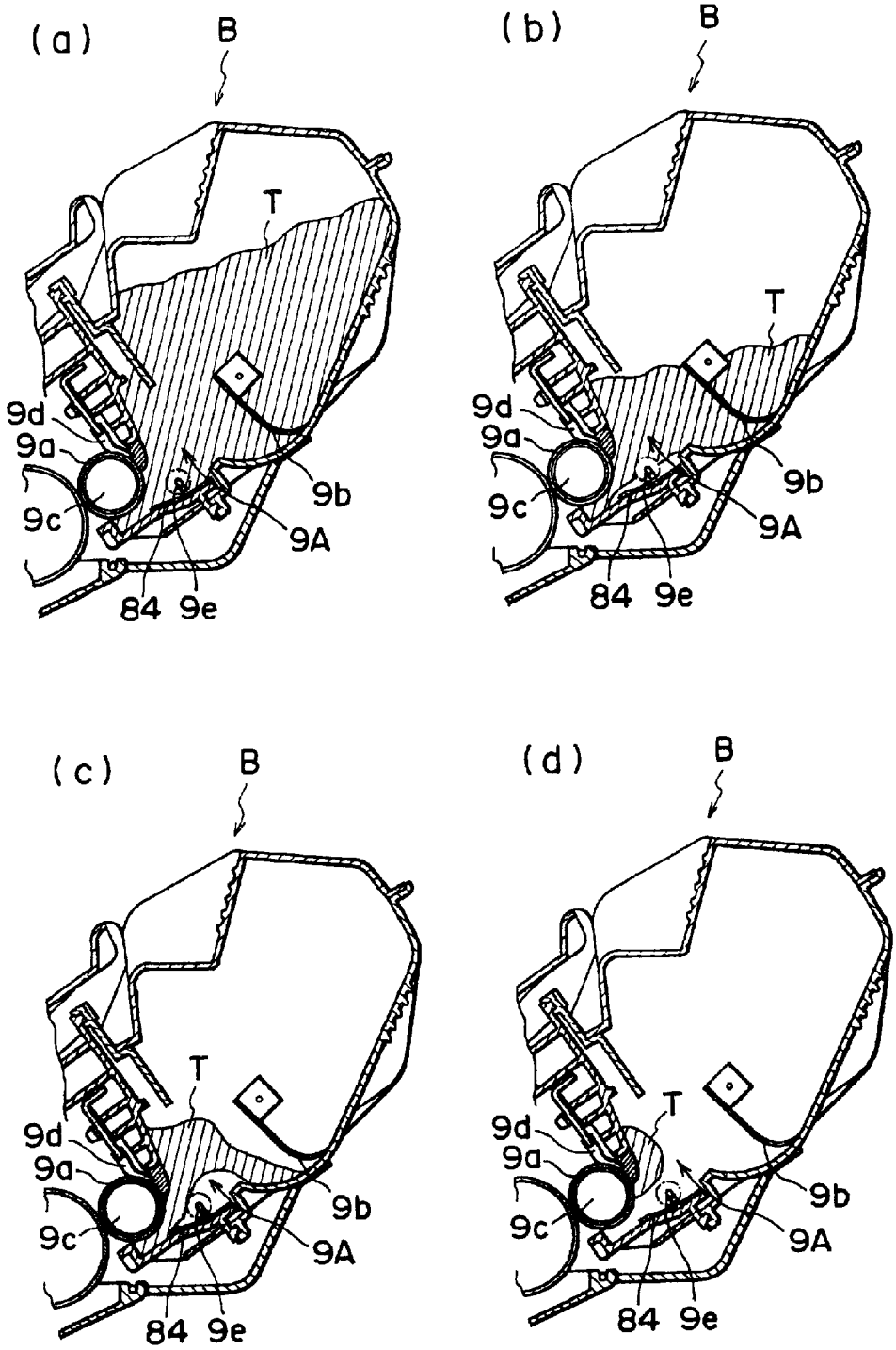
FIG. 26 illustrates the developer and a bottle electrode when the amount of the developer in a developer chamber is decreasing.

More specifically, referring to FIG. 26, when the amount of the developer remaining in the developer container 11 is relatively large, the developer in the developer container 11 descends into the development chamber 9A due to the self-weight of the developer mass, and therefore, as the developer in the development chamber 9A is consumed as described above, the consumed developer is immediately replaced by the developer forced into the development chamber 9A due to the self-weight of the developer mass (FIG. 26(*a*)). However, as the amount of the developer remaining in the developer container 11 decreases, the force which forces developer into the development chamber 9A also decreases, failing to force the developer into the development chamber 9A by an amount equal to the amount of the developer consumed from the development chamber 9A. As a result, a cavity develops starting from the adjacencies of the bottom surface of the development chamber 9A (FIGS. 26(*b*) and 26(*c*)). Eventually, a state in which developer remains only around the longitudinal edge of the development blade 9*d* results (FIG. 26(*d*)).

Since the developer in the process cartridge B is consumed as described above, the structural arrangement in this embodiment makes it possible to continuously detect the developer amount in the adjacencies of the bottom surface of the development chamber 9A.

Figure 27:
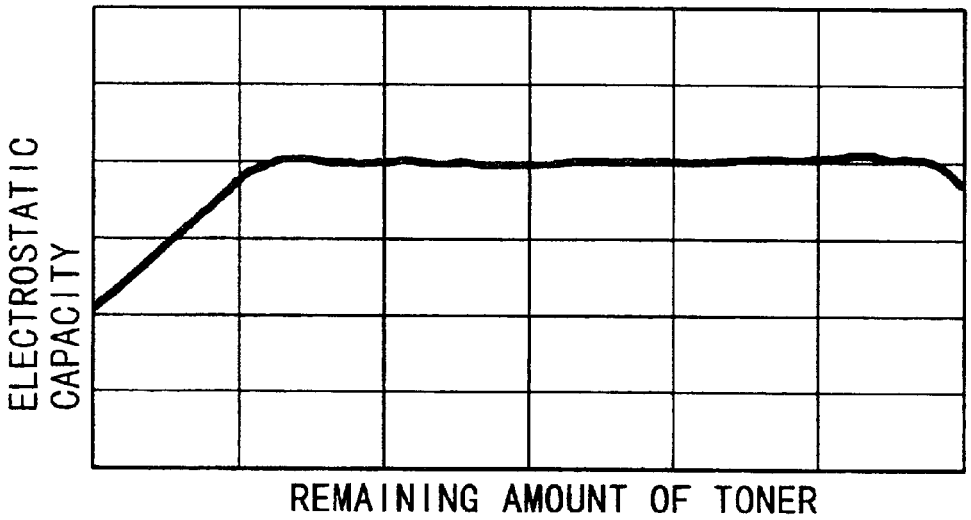
FIG. 27 shows a relationship between the amount of the toner and an electrostatic capacity in the developer amount detecting device of FIG. 24.
Figure 28:
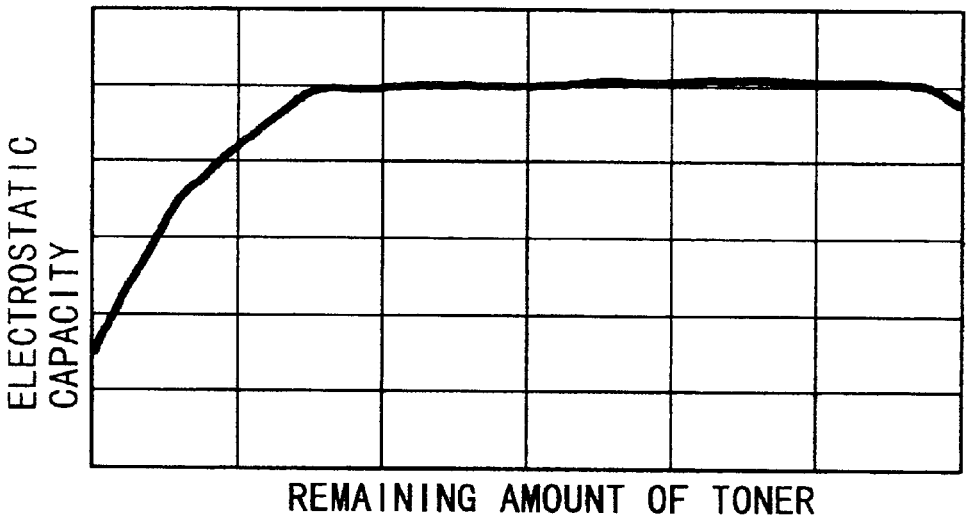
FIG. 28 shows a relationship between the amount of the toner and an electrostatic capacity in the developer amount detecting device of FIG. 24 with the intermediary electrode.

The graph in FIG. 27 shows typical changes in the electrostatic capacity which occurs as the developer remainder amount decreases. As is evident from FIG. 27, even if the structural arrangement in this embodiment is employed, the developer remainder amount is continuously detectable. However, this structural arrangement is not as accurate as that in the first embodiment in terms of the detection of the threshold developer level below which images with abnormal white spots are produced.

Figure 25:
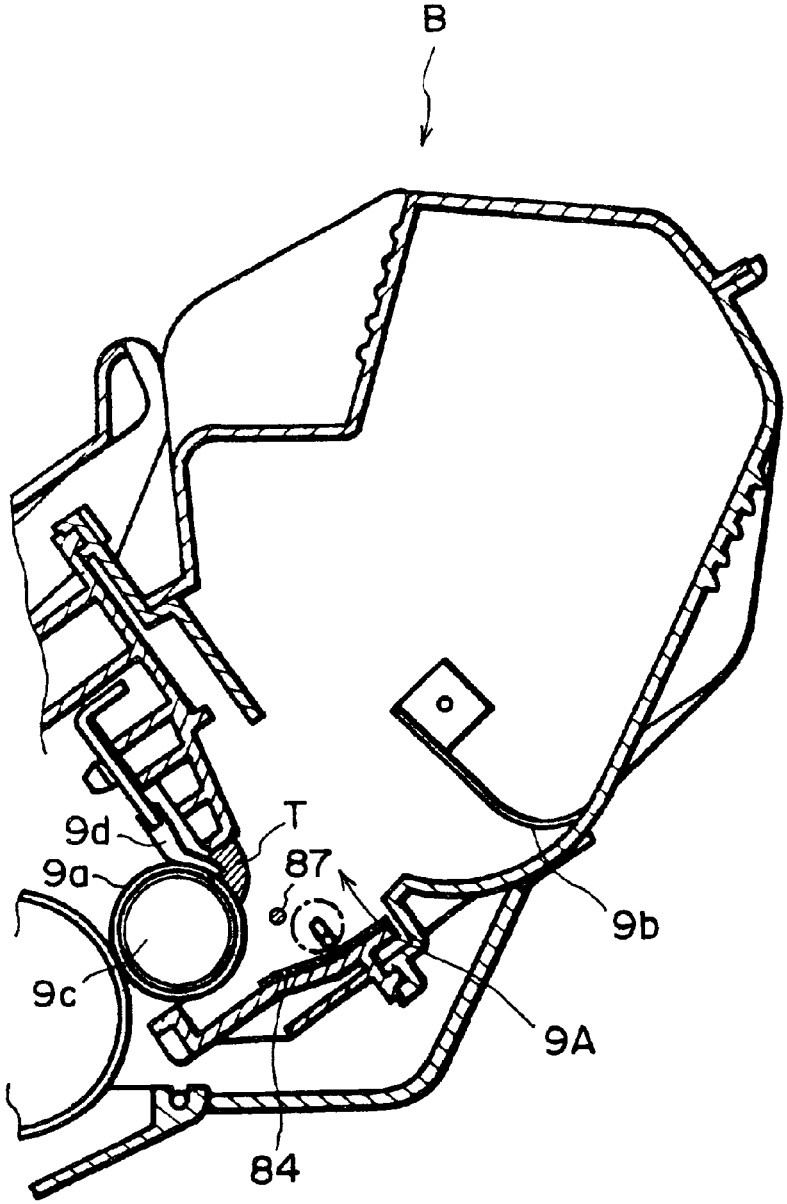
FIG. 25 is a constitutional sectional view of a major part of the developer amount detecting means of FIG. 24 in which an intermediary electrode is provided.

Thus, when it is necessary to increase the detection sensitivity to the threshold developer level, it is possible to employ an additional element such as the third electrode 83 in the first embodiment. However, in order to increase the sensitivity of the developer amount detecting apparatus, in the bottom portion of the development chamber 9A, a rod electrode 87 as an intermediary electrode, which extends across the entire longitudinal range of the development roller 9*a*, in parallel to the development roller 9*a* and developer path electrode 84, as shown in FIG. 25, may be provided. With this arrangement, the developer path electrode 84 and rod electrode 87 serve as two electrodes of a condenser; in other words, the distance between the two electrodes of a condenser becomes smaller, increasing the detection sensitivity. More specifically, the intermediary electrode 87 is provided; the development roller 9*a* and third electrode 83 are equalized in potential level, and connected to the development bias circuit 101 as a development bias applying means; and the intermediary electrode 87 is connected to the control circuit 102 of the developer amount detection circuit 100. Therefore, the sensitivity with which the developer remainder amount is detected, and the sensitivity with which the threshold developer level is detected, are raised without inviting a drastic cost increase. Further, with this structural arrangement, the electrostatic capacity changes in response to the decrease in the developer remainder amount as indicated by the graph in FIG. 28. The selection of the structural arrangement for a process cartridge B does not need to be limited to those described above. As a matter of fact it does not matter where the electrodes are placed, as long as the sensitivity with which developer presence is detected can be improved.

Embodiment 3

Next, the third embodiment of the present invention will be described.

Also in this embodiment, an image forming apparatus which is similar in structure and function to the image forming apparatus in the first or second embodiments was employed. The components in this embodiment similar to those in the first and second embodiments will be given the same referential codes. Further, the component arrangement in terms of the longitudinal direction of the process cartridge, the structures in the adjacencies of the electrodes, and the like, which are identical to those in the first and second embodiments, will not be described.

According to the arrangement in this embodiment, the developer remainder amount can be detected much more accurately than in the first and second embodiments.

As one of the methods for improving detection accuracy, it is possible to increase detection sensitivity. However, it is difficult to substantially increase the sensitivity by simply making a few changes to the shapes and positioning of the electrodes, based on the structures in the first and second embodiments.

Figure 29:
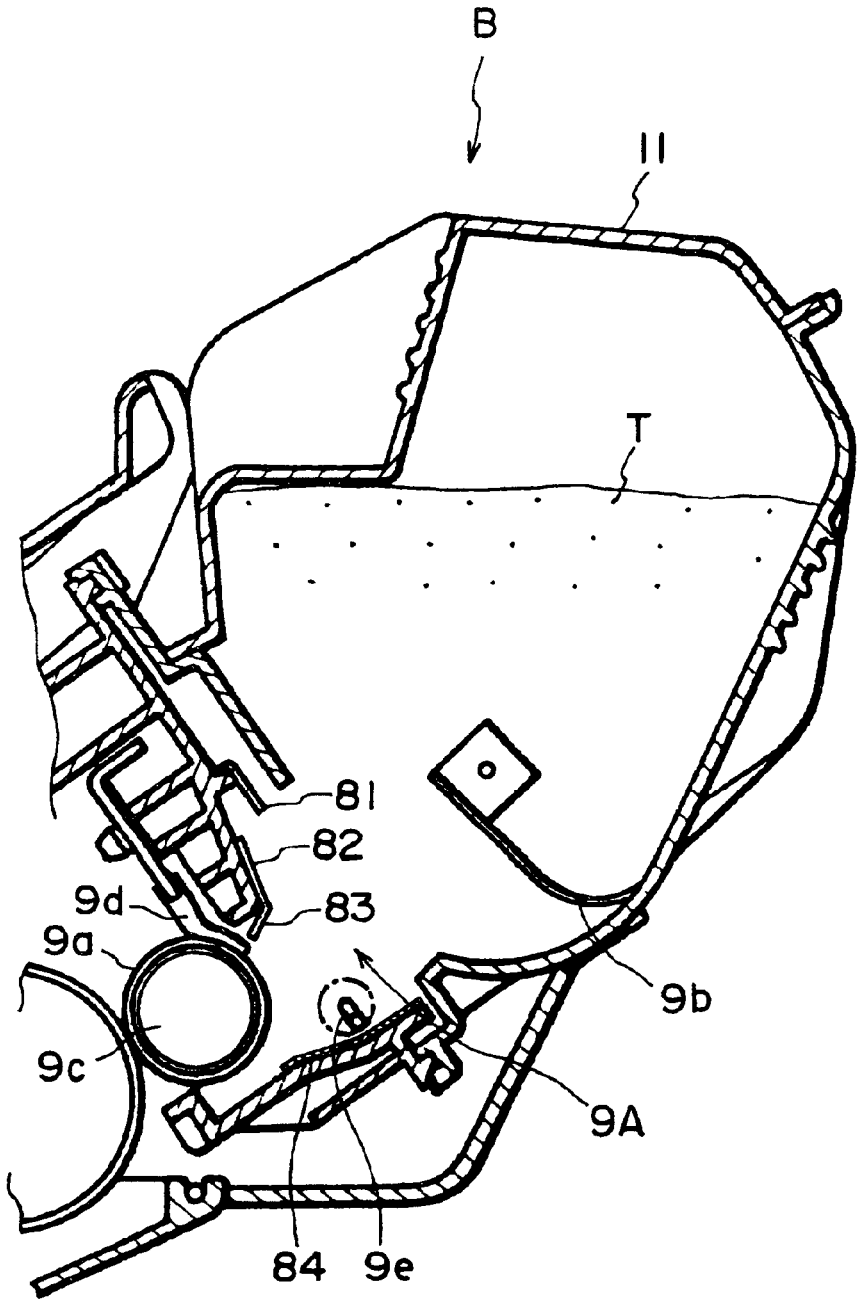
FIG. 29 is a longitudinal sectional view of a major part of a developer amount detecting means according to a further embodiment of the present invention.

Thus, in this embodiment, the structural arrangement in the first embodiment, in other words, the structure having the first, second, and third electrodes 31, 32, and 83 as illustrated in FIG. 19, and the structural arrangement in the second embodiment, in other words, the structure in which the developer path electrode 84 was placed on the bottom surface of the developer chamber 9A as illustrated in FIG. 24, were employed in combination as shown in FIG. 29.

With regard to the threshold developer level detection, a sufficient level of detection accuracy was achieved by the condenser portion constituted of a combination of the third electrode 83 and development roller 9*a* in the first embodiment, and therefore, the intermediary electrode 87 was not employed in this embodiment. However, employing the intermediary electrode 87 depending on circumstances does not cause any problem, and will provide the same effects as those provided by this embodiment.

With the provision of the above described structural arrangement, the detection sensitivity increases by a large margin, and therefore, the developer remainder amount can be continuously detected with greater accuracy. Further, the area in which the developer remainder amount can be detected extends across the entire range of the development chamber 9A in terms of its longitudinal direction, and therefore, even if the state of the developer mass in the developer container 11 temporarily changes due to circumstances, for example, because a process cartridge is taken out of the image forming apparatus main assembly and is shaken, the developer remainder amount detected after such a temporary change rarely deviates from the developer remainder amount detected prior to such a change.

In this embodiment, the development roller 9*a* and first electrode 81 are equalized in electrical potential, and are connected to the development bias circuit 101, whereas the second electrode 82 and developer path electrode 84 are equalized in electrical potential level and are connected to the control circuit 102 of the developer amount detection circuit 100.

How these electrodes or their equivalents are connected in terms of circuit design does not need to be exactly as described above; it does not matter as long as their connection realizes a high level of detection sensitivity, in particular, in the adjacencies of the bottom surface of the development chamber, and also in the adjacencies of the first and second electrodes 81 and 82.

Also regarding the connection of the a electrodes, cost increase can be avoided by equalizing, in electrical potential level, the electrodes which are to be equalized in electrical potential level, by connecting them to each other, because such an arrangement does not increase the number of contact points between these electrodes and the power source on the main assembly side.

Figure 30:
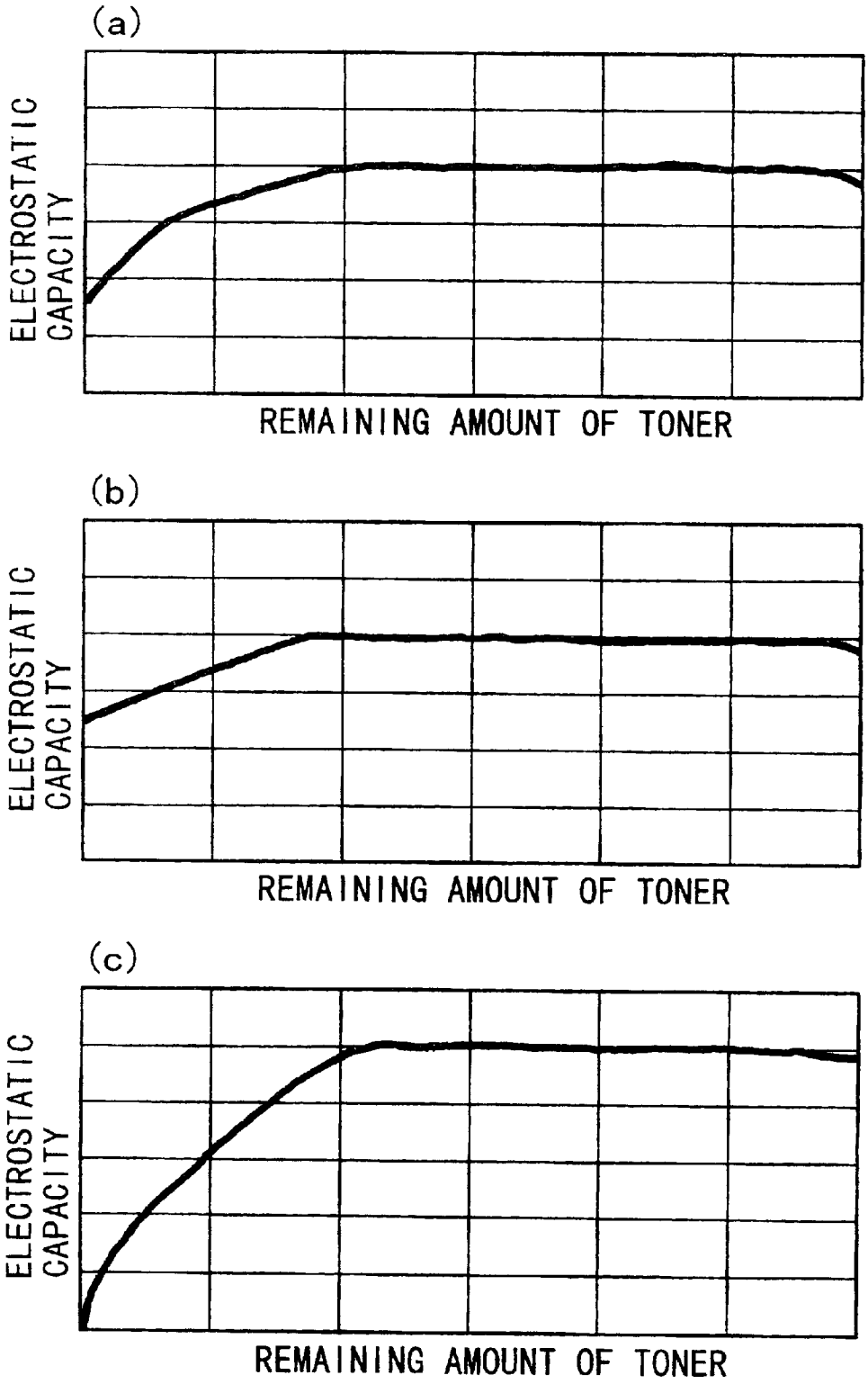
FIG. 30 shows relationships between the toner amount and an electrostatic capacity in the developer amount detecting devices of each of FIGS. 19, 24 and 29.

FIGS. 30(*a*) and 30(*b*) show the relationships between the changes in the developer amount, and the changes in the electrostatic capacity which occurred in response to the changes in the developer amount, in the first and second embodiments, respectively. FIG. 30(*c*) shows a typical relationship between the changes in the developer amount, and the changes in the electrostatic capacity which occurred in response to the change in the developer amount, when the structure in this embodiment was employed.

It is evident from these graphs that the developer remainder amount can be also accurately detected with the use of the structure in this embodiment.

Also in this embodiment, a flat piece of electrically conductive material was employed as the developer path electrode 84, and was fixed to the internal surface of the container wall. However, the configuration of the developer path electrode 84 does not need to be limited to the one employed in this embodiment. For example, the developer electrode 84 may be fixed to the external surface of the container wall, or it may be fixed in a manner to hold a certain distance from the container wall. Further, it may comprise a plurality of electrically conductive rods placed in parallel. In other words, as long as it is placed across the path through which developer is conveyed to the developing member by the developer stirring-conveying member, it is possible to obtain the same effects as those obtained with the use of the structural arrangement in this embodiment.

Incidentally, in the above described embodiments, the developer remainder amount can be continuously detected while the developer remainder amount is in a range from approximately 30% down to 0%, assuming that the developer container is 100% full prior to its initial usage of a process cartridge. However, the present invention is not limited by this arrangement. In other words, the range in which the developer remainder amount in the container can be continuously detected may be set to a range from 50% down to 0% or a range from 40% down to 0%, for example. Here, an indication that the developer remainder amount is 0% does not means that the developer has been completely depleted. It also includes such a condition that the developer amount in the container has decreased to a level below which an image with a predetermined level of quality can not be obtained.

As is evident from the above description of the embodiments of the present invention, according to the present invention, the developer amount can be continuously detected with a high level of accuracy, and therefore, usability can be improved.

While the invention has been described with reference to the structures disclosed herein, it is not confined to the details set forth, and this application is intended to cover such modifications or changes as may come within the purposes of the improvements or the scope of the following claims.

What is claimed is:

1. A developing device for developing an electrostatic latent image formed on an electrophotographic photosensitive member, said developing device being usable with a main assembly of an electrophotographic image forming apparatus, said developing device comprising:

an elongate developing member for supplying a developer to the electrophotographic photosensitive member for developing the electrostatic latent image formed on the electrophotographic photosensitive member;

a first electrode disposed along a length of said developing member; and a second electrode, disposed along a length of said first electrode, wherein said first electrode is disposed such that at least a lower end thereof takes a position above said second electrode when said developing device is mounted to the main assembly of the electrophotographic image forming apparatus, wherein said second electrode is disposed closer to said developing member than said first electrode, wherein an electrical signal is generated in accordance with an electrostatic capacity between said first electrode and second electrode when said first electrode or second electrode is supplied with a voltage from the main assembly of said electrophotographic image forming apparatus, and is measured by the main assembly of the electrophotographic image forming apparatus to detect a remaining amount of the developer.

2. A device according to claim 1, wherein said first electrode and a frame supporting said second electrode constitute a recess extending parallel to a developing device frame, wherein said recess opens downward.

3. A device according to claim 2, wherein one and the other of said first and second electrodes are plate-like and rod-like electrodes.

4. A developing device for developing an electrostatic latent image formed on an electrophotographic photosensitive member, said developing device being usable with a main assembly of an electrophotographic image forming apparatus, said developing device comprising:

an elongate developing member for supplying a developer to the electrophotographic photosensitive member to develop the electrostatic latent image formed on the electrophotographic photosensitive member;

a first electrode disposed along a length of said development member;

a second electrode, disposed along a length of said first electrode, wherein said first electrode is disposed such that at least a lower end thereof takes a position above said second electrode when said developing device is mounted to the main assembly of the electrophotographic image forming apparatus, wherein said second electrode is disposed closer to said developing member than said first electrode, a third electrode disposed between said first electrode and said developing member;

a first electrical contact for receiving, from the main assembly of the electrophotographic image forming apparatus, a voltage to be applied to said first electrode when said developing device is mounted to the main assembly of the electrophotographic image forming apparatus;

a second electrical contact for receiving, from the main assembly of the electrophotographic image forming apparatus, a voltage to be applied to said developing member when said developing device is mounted to the main assembly of the electrophotographic image forming apparatus; and a third electrical contact for transmitting, to the main assembly of the electrophotographic image forming apparatus, an electrical signal corresponding at least to electrostatic capacities between said first electrode and second electrode and between said developing member and said third electrode, when the voltages are applied to said first electrode and to said developing member, to detect a remaining amount of the developer by the main assembly of the electrophotographic image forming apparatus.

5. A device according to claim 4, wherein said first electrode and a frame supporting said second electrode constitute a recess extending parallel to said developing member, said recess opening downward.

6. A device according to claim 4 or 5, wherein said third electrode is a member which is integral with or separate from said second electrode.

7. A device according to claim 6, further comprising a developer chamber having an opening in which said developing member is supported, and a developer container, connected with said developer chamber, for accommodating the developer, wherein said first, second and third electrodes are provided in said developer chamber.

8. A device according to claim 1 or 4, further comprising developer stirring means for stirring the developer, wherein at least said first and second electrodes are disposed in a moving range of the developer provided by rotation of said developer stirring means.

9. A developing device for developing an electrostatic latent image formed on an electrophotographic photosensitive member, said developing device being usable with a main assembly of an electrophotographic image forming apparatus, said developing device comprising:

an elongate developing member for supplying a developer to the electrophotographic photosensitive member to develop the electrostatic latent image formed on the electrophotographic photosensitive member;

a first electrode disposed along a length of said developing member;

a second electrode, disposed along a length of said first electrode, wherein said first electrode is disposed such that at least a lower end thereof takes a position above said second electrode when said developing device is mounted to the main assembly of the electrophotographic image forming apparatus, wherein said second electrode is disposed closer to said developing member than said first electrode;

a developer path electrode disposed along a path along which the developer accommodated in a developer accommodating portion moves to said developing member;

a first electrical contact for receiving, from the main assembly of the electrophotographic image forming apparatus, a voltage to be applied to said first electrode when said developing device is mounted to the main assembly of the electrophotographic image forming apparatus;

a second electrical contact for receiving, from the main assembly of the electrophotographic image forming apparatus, a voltage to be applied to said developing member when said developing device is mounted to the main assembly of the electrophotographic image forming apparatus; and a third electrical contact for transmitting, to the main assembly of the electrophotographic image forming apparatus, an electrical signal corresponding to electrostatic capacities at least between said first electrode and said second electrode and between said developing member and said developer path electrode to detect a remaining amount of the developer by the main assembly of the electrophotographic image forming apparatus.

10. A device according to claim 9, wherein said developer path electrode is in the form of a plate extending along the path.

11. A device according to claim 9, further comprising a third electrode provided between said second electrode and said developing member.

12. A device according to claim 11, wherein said third electrode is a member which is integral with or separate from said second electrode.

13. A device according to claim 9 or 12, wherein said developing member is in the form of a developing roller.

14. A device according to claim 9 or 12, further comprising developer stirring means for stirring the developer, wherein at least said first electrode and second electrode are disposed in a moving range of the developer provided by rotation of said developer stirring means.

15. A device according to claim 9, wherein said first electrode and a frame supporting said second electrode constitute a recess extending parallel to said developing member, said recess opening downward.

16. A device according to claim 9, further comprising an intermediary electrode between said developing member and said developer path electrode.

17. A device according to claim 1, 4 or 9, further comprising a stirring member for stirring the developer accommodated therein, wherein at least a lower end of said first electrode takes a position above said second electrode in a direction of movement of the developer provided by said stirring member, when said developing device is mounted to the main assembly of the electrophotographic image forming apparatus.

18. A process cartridge detachably mountable to a main assembly of an electrophotographic image forming apparatus, comprising:

(a) an electrophotographic photosensitive member; and (b) a developing device including:

an elongate developing member for supplying a developer to said electrophotographic photosensitive member to develop an electrostatic latent image formed on said electrophotographic photosensitive member;

a first electrode disposed along a length of said developing member; and a second electrode, disposed along a length of said first electrode, wherein said first electrode is disposed such that at least a lower end thereof takes a position above said second electrode when said process cartridge is mounted to the main assembly of the electrophotographic image forming apparatus, wherein said second electrode is disposed closer to said developing member than said first electrode, wherein an electrical signal is generated in accordance with an electrostatic capacity between said first electrode and second electrode when said first electrode or second electrode is supplied with a voltage from the main assembly of the electrophotographic image forming apparatus, and is measured by the main assembly of the electrophotographic image forming apparatus to detect a remaining amount of the developer.

19. A process cartridge according to claim 18, wherein said first electrode and a frame supporting said second electrode constitute a recess extending parallel to a developing device frame, said recess opening downward.

20. A process cartridge according to claim 18 or 19, wherein one and the other of said first and second electrodes are plate-like and rod-like electrodes.

21. A process cartridge detachably mountable to a main assembly of an electrophotographic image forming apparatus, comprising:

(a) an electrophotographic photosensitive member; and (b) a developing device including:

an elongate developing member for supplying a developer to said electrophotographic photosensitive member to develop an electrostatic latent image formed on said electrophotographic photosensitive member;

a first electrode disposed along a length of said developing member;

a second electrode, disposed along a length of said first electrode, wherein said first electrode is disposed such that at least a lower end thereof takes a position above said second electrode when said process cartridge is mounted to the main assembly of the electrophotographic image forming apparatus, wherein said second electrode is disposed closer to said developing member than said first electrode, a third electrode disposed between said second electrode and said developing member;

a first electrical contact for receiving, from the main assembly of the electrophotographic image forming apparatus, a voltage to be applied to said first electrode when said process cartridge is mounted to the main assembly of the electrophotographic image forming apparatus;

a second electrical contact for receiving, from the main assembly of the electrophotographic image forming apparatus, a voltage to be applied to said developing member when said process cartridge is mounted to the main assembly of the electrophotographic image forming apparatus; and a third electrical contact for transmitting, to the main assembly of the electrophotographic image forming apparatus, an electrical signal corresponding at least to electrostatic capacities between said first electrode and said second electrode and between said developing member and said third electrode, when the voltages are applied to said first electrode and to said developing member, to detect a remaining amount of the developer by the main assembly of the electrophotographic image forming apparatus.

22. A process cartridge according to claim 21, wherein said first electrode and a frame supporting said second electrode constitute a recess extending parallel to a developing device frame, said recess opening downward.

23. A process cartridge according to claim 21 or 22, wherein said third electrode is a member which is integral with or separate from said second electrode, and is disposed opposed to said developing member.

24. A process cartridge according to claim 23, further comprising a developer chamber having an opening in which said developing member is supported, and a developer container, connected with said developer chamber, for accommodating the developer, wherein said first, second and third electrodes are provided in said developer chamber.

25. A process cartridge according to claim 21 or 22, further comprising developer stirring means for stirring the developer, wherein at least said first and second electrodes are disposed in a moving range of the developer provided by rotation of said developer stirring means.

26. A process cartridge detachably mountable to a main assembly of an electrophotographic image forming apparatus, comprising:

(a) an electrophotographic photosensitive member; and (b) a developing device including:

an elongate developing member for supplying a developer to said electrophotographic photosensitive member to develop an electrostatic latent image formed on the electrophotographic photosensitive member;

a first electrode disposed along a length of said developing member;

a second electrode, disposed along a length of said first electrode, wherein said first electrode is disposed such that at least a lower end thereof takes a position above said second electrode when said process cartridge is mounted to the main assembly of the electrophotographic image forming apparatus, wherein said second electrode is disposed closer to said developing member than said first electrode;

a developer path electrode disposed along a path along which the developer accommodated in a developer accommodating portion moves to said developing member;

a first electrical contact for receiving, from the main assembly of the electrophotographic image forming apparatus, a voltage to be applied to said first electrode when said process cartridge is mounted to the main assembly of the electrophotographic image forming apparatus;

a second electrical contact for receiving, from the main assembly of the electrophotographic image forming apparatus, a voltage to be applied to said developing member when said process cartridge is mounted to the main assembly of the electrophotographic image forming apparatus; and a third electrical contact for transmitting, to the main assembly of the electrophotographic image forming apparatus, an electrical signal corresponding to electrostatic capacities at least between said first electrode and said second electrode and between said developing member and said developer path electrode to detect a remaining amount of the developer by the main assembly of the electrophotographic image forming apparatus.

27. A process cartridge according to claim 26, wherein said developer path electrode is in the form of a plate extending along the path.

28. A process cartridge according to claim 26, further comprising a third electrode provided between said second electrode and said developing member.

29. A process cartridge according to claim 28, wherein said third electrode is a member which is integral with or separate from said first electrode.

30. A process cartridge according to claim 26 or 29, wherein said developing member is in the form of a developing roller.

31. A process cartridge according to claim 26 or 29, wherein said first electrode and a frame supporting said second electrode constitute a recess extending parallel to said developing member, and wherein said recess opens downward.

32. A process cartridge according to claim 26, further comprising an intermediary electrode between said developing member and said developer path electrode.

33. A process cartridge according to claim 26 or 29, further comprising developer stirring means for stirring the developer, wherein at least said first and second electrodes are disposed in a moving range of the developer provided by rotation of said developer stirring means.

34. A process cartridge according to claim 18, 21 or 26, further comprising a stirring member for stirring the developer accommodated therein, wherein at least a lower end of said first electrode takes a position above said second electrode in a direction of movement of the developer provided by said stirring member, when said developing device is mounted to the main assembly of the electrophotographic image forming apparatus.

35. An electrophotographic image forming apparatus for forming an image on a recording material, comprising:

(a) an electrophotographic photosensitive member;

(b) an electrostatic latent image forming means for forming an electrostatic latent image on said electrophotographic photosensitive member; and (c) a developing device for developing the electrostatic latent image formed on said electrophotographic photosensitive member, said developing device including:

an elongate developing member for supplying a developer to said electrophotographic photosensitive member;

a first electrode disposed along a length of said developing memeber; and a second electrode, disposed along a length of said first electrode, wherein said first electrode is disposed such that at least a lower end thereof takes a position above said second electrode when said developing device is mounted to a main assembly of said electrophotographic image forming apparatus, wherein said second electrode is disposed closer to said developing member than said first electrode, wherein an electrical signal is generated in accordance with an electrostatic capacity between said first electrode and second electrode when said first electrode or second electrode is supplied with a voltage from the main assembly of said electrophotographic image forming apparatus, and is measured by the main assembly of said electrophotographic image forming apparatus to detect a remaining amount of the developer.

36. An electrophotographic image forming apparatus for forming an image on a recording material, wherein a process cartridge is detachably mountable to a main assembly of said electrophotographic image forming apparatus, said electrophotographic image forming apparatus comprising:

(a) mounting means for mounting the process cartridge, the process cartridge including:

an electrophotographic photosensitive member;

an elongate developing member for supplying a developer to the electrophotographic photosensitive member to develop an electrostatic latent image formed on the electrophotographic photosensitive member;

a first electrode disposed along a length of said developing member; and a second electrode, disposed along a length of said first electrode, wherein said first electrode is disposed such that at least a lower end thereof takes a position above the second electrode when the process cartridge is mounted to the main assembly of said electrophotographic image forming apparatus, wherein said second electrode is disposed closer to said developing member than said first electrode, (b) electrostatic latent image forming means for forming the electrostatic latent image on the electrophotographic photosensitive member; and (c) developer remaining amount detecting means for detecting a remaining amount of the developer by measuring an electrical signal which is produced by application of a voltage to the first electrode or second electrode and which corresponds to an electrostatic capacity between the first electrode and the second electrode.

37. A apparatus according to claim 35 or 36, wherein the first electrode and a frame supporting the second electrode constitute a recess extending parallel to a developing device frame, the recess opening downward.

38. An apparatus according to claim 35 or 36, wherein one and the other of the first and second electrodes are plate-like and rod-like electrodes.

39. An electrophotographic image forming apparatus for forming an image on a recording material, comprising:

(a) an electrophotographic photosensitive member;

(b) an electrostatic latent image forming means for forming an electrostatic latent image on said electrophotographic photosensitive member;

(c) a developing device for developing the electrostatic latent image formed on said electrophotographic photosensitive member, said developing device including:

an elongate developing member for supplying a developer to said electrophotographic photosensitive member to develop the electrostatic latent image formed on said electrophotographic photosensitive member;

a first electrode disposed along a length of said developing member;

a second electrode, disposed along a length of said first electrode, wherein said first electrode is disposed such that at least a lower end thereof takes a position above said second electrode when said developing device is mounted to a main assembly of said electrophotographic image forming apparatus, wherein said second electrode is disposed closer to said developing member than said first electrode, a third electrode disposed between said first electrode and said developing member;

a first electrical contact for receiving, from the main assembly of said electrophotographic image forming apparatus, a voltage to be applied to said first electrode when said developing device is mounted to the main assembly of said electrophotographic image forming apparatus;

a second electrical contact for receiving, from the main assembly of said electrophotographic image forming apparatus, a voltage to be applied to said developing member when said developing device is mounted to the main assembly of said electrophotographic image forming apparatus; and a third electrical contact for transmitting, to the main assembly of said electrophotographic image forming apparatus, an electrical signal corresponding at least to electrostatic capacities between said first electrode and said second electrode and between said developing member and said third electrode, when the voltages are applied to said first electrode and to said developing member; and (d) developer amount detecting means for detecting an amount of the developer in said developing device on the basis of the electrical signal transmitted from said third electrical contact.

40. An electrophotographic image forming apparatus for forming an image on a recording material, wherein a process cartridge is detachably mountable to a main assembly of said electrophotographic image forming apparatus, said electrophotographic image forming apparatus comprising:

(a) mounting means for detachably mounting the process cartridge, the process cartridge including:

an electrophotographic photosensitive member;

an elongate developing member for supplying a developer to the electrophotographic photosensitive member to develop an electrostatic latent image formed on the electrophotographic photosensitive member;

a first electrode disposed along a length of said developing member;

a second electrode, disposed along a length of said first electrode, wherein said first electrode is disposed such that at least a lower end thereof takes a position above the second electrode when the process cartridge is mounted to the main assembly of said electrophotographic image forming apparatus; wherein said second electrode is disposed closer to said developing member than said first electrode, a third electrode disposed between the second electrode and the developing member;

a first electrical contact for receiving, from the main assembly of said electrophotographic image forming apparatus, a voltage to be applied to said first electrode when the process cartridge is mounted to the main assembly of said electrophotographic image forming apparatus;

a second electrical contact for receiving, from the main assembly of said electrophotographic image forming apparatus, a voltage to be applied to the developing member when the process cartridge is mounted to the main assembly of said electrophotographic image forming apparatus; and a third electrical contact for transmitting, to the main assembly of said electrophotographic image forming apparatus, an electrical signal corresponding at least to electrostatic capacities between the first electrode and the second electrode and between the developing member and the third electrode, when the voltages are applied to the first electrode and to the developing member, to detect a remaining amount of the developer by the main assembly of said electrophotographic image forming apparatus;

(b) electrostatic latent image forming means for forming the electrostatic latent image on the electrophotographic photosensitive member; and (c) developer amount detecting means for detecting an amount of the developer in the process cartridge on the basis of the electrical signal transmitted from the third electrical contact.

41. An apparatus according to claim 39 or 40, wherein the first electrode and a frame supporting the second electrode constitute a recess extending parallel to the developing member, the recess opening downward.

42. An apparatus according to claim 39 or 40, wherein the third electrode is a member which is integral with or separate from the second electrode.

43. An apparatus according to claim 39 or 40, further comprising a developer chamber having an opening in which the developing member is supported, and a developer container, connected with said developer chamber, for accommodating the developer, wherein the first, second and third electrodes are provided in said developer chamber.

44. An apparatus according to claim 35, 36, 39, or 40, further comprising developer stirring means for stirring the developer, wherein at least the first and second electrodes are disposed in a moving range of the developer provided by rotation of said developer stirring means.

45. An electrophotographic image forming apparatus for forming an image on a recording material, comprising:

(a) an electrophotographic photosensitive member;

(b) an electrostatic latent image forming means for forming an electrostatic latent image on said electrophotographic photosensitive member;

(c) a developing device for developing the electrostatic latent image formed on said electrophotographic photosensitive member, said developing device including:

an elongate developing member for supplying a developer to said electrophotographic photosensitive member to develop the electrostatic latent image formed on said electrophotographic photosensitive member;

a first electrode disposed along a length of said developing member;

a second electrode, disposed along a length of said first electrode, wherein said first electrode is disposed such that at least a lower end thereof takes a position above said second electrode when said developing device is mounted to a main assembly of said electrophotographic image forming apparatus, wherein said second electrode is disposed closer to said developing member than said first electrode;

a developer path electrode disposed along a path along which the developer accommodated in a developer accommodating portion moves to said developing member;

a first electrical contact for receiving, from the main assembly of said electrophotographic image forming apparatus, a voltage to be applied to said first electrode when said developing device is mounted to the main assembly of said electrophotographic image forming apparatus;

a second electrical contact for receiving, from the main assembly of said electrophotographic image forming apparatus, a voltage to be applied to said developing member when said developing device is mounted to the main assembly of said electrophotographic image forming apparatus; and a third electrical contact for transmitting, to the main assembly of said electrophotographic image forming apparatus, an electrical signal corresponding to electrostatic capacities at least between said first electrode and said second electrode and between said developing member and said developer path electrode to detect a remaining amount of the developer by the main assembly of said electrophotographic image forming apparatus.

46. An electrophotographic image forming apparatus for forming an image on a recording material, wherein a process cartridge is detachably mountable to a main assembly of said electrophotographic image forming apparatus, said electrophotographic image forming apparatus comprising:

(a) mounting means for detachably mounting the process cartridge, the process cartridge including:

an electrophotographic photosensitive member;

an elongate developing member for supplying a developer to the electrophotographic photosensitive member to develop an electrostatic latent image formed on the electrophotographic photosensitive member;

a first electrode disposed along a length of said developing member;

a second electrode, disposed along a length of said first electrode, wherein said first electrode is disposed such that at least a lower end thereof takes a position above the second electrode when the process cartridge is mounted to the main assembly of said electrophotographic image forming apparatus, wherein said second electrode is disposed closer to said developing member than said first electrode, a developer path electrode disposed along a path along which the developer accommodated in a developer accommodating portion moves to the developing member;

a first electrical contact for receiving, from the main assembly of said electrophotographic image forming apparatus, a voltage to be applied to the first electrode when the process cartridge is mounted to the main assembly of said electrophotographic image forming apparatus;

a second electrical contact for receiving, from the main assembly of said electrophotographic image forming apparatus, a voltage to be applied to the developing member when the process cartridge is mounted to the main assembly of said electrophotographic image forming apparatus; and a third electrical contact for transmitting, to the main assembly of said electrophotographic image forming apparatus, an electrical signal corresponding to electrostatic capacities at least between the first electrode and the second electrode and between the developing member and the developer path electrode to detect a remaining amount of the developer by the main assembly of said electrophotographic image forming apparatus;

(b) electrostatic latent image forming means for forming the electrostatic latent image on the electrophotographic photosensitive member; and (c) developer amount detecting means for detecting an amount of the developer in the process cartridge on the basis of the electrical signal transmitted from the third electrical contact.

47. An apparatus according to claim 45 or 46, wherein the developer path electrode is in the form of a plate extending along the path.

48. An apparatus according to claim 45 or 46, further comprising a third electrode provided between the second electrode and the developing member.

49. An apparatus according to according to claim 48, wherein the third electrode is a member which is integral with or separate from the first electrode.

50. An apparatus according to claim 45 or 46, wherein the developing member is in the form of a developing roller.

51. An apparatus according to claim 45 or 46, wherein the first electrode and a frame supporting the second electrode constitute a recess extending parallel to the developing member, and wherein the recess opens downward.

52. An apparatus according to claim 45 or 46, further comprising an intermediary electrode between the developing member and the developer path electrode.

53. An apparatus according to claim 45 or 46, further comprising developer stirring means for stirring the developer, wherein at least the first electrode and said second electrode are disposed in a moving range of the developer provided by rotation of said developer stirring means.

* * * * *

UNITED STATES PATENT AND TRADEMARK OFFICE

CERTIFICATE OF CORRECTION

PATENT NO. : 6,892,035 B2
APPLICATION NO. : 09/826171
DATED : May 10, 2005
INVENTOR(S) : Hideki Matsumoto et al.

It is certified that error appears in the above-identified patent and that said Letters Patent is hereby corrected as shown below:

ON THE COVER PAGE
Item (30), Foreign Application Priority Data, "2000/105505" should read --2000-105505--.

COLUMN 1
Line 47, "on" should read --on a--.

COLUMN 3
Line 8, "is" should read --are--.
Line 37, "divides" should read --devices--.

COLUMN 5
Line 15, "top" should read --top of--.

COLUMN 7
Line 43, "the a state" should read --a state--.

COLUMN 11
Line 1, "17fb)" should read --17(b)--.

COLUMN 12
Line 36, "on magnetic" should read --nonmagnetic--.

UNITED STATES PATENT AND TRADEMARK OFFICE

CERTIFICATE OF CORRECTION

PATENT NO. : 6,892,035 B2
APPLICATION NO. : 09/826171
DATED : May 10, 2005
INVENTOR(S) : Hideki Matsumoto et al.

It is certified that error appears in the above-identified patent and that said Letters Patent is hereby corrected as shown below:

COLUMN 13
Line 43, “are” should read --is--.

COLUMN 16
Line 50, “be also” should read --also be--.

COLUMN 17
Line 12, “means” should be --mean--.

COLUMN 23
Line 37, “A apparatus” should read --An apparatus--.

COLUMN 26
Line 35, “electrode,” should read --electrode;--.

Signed and Sealed this

Eighteenth Day of July, 2006

JON W. DUDAS
*Director of the United States Patent and Trademark Office*